US011441392B2

(12) United States Patent
Fripp et al.

(10) Patent No.: US 11,441,392 B2
(45) Date of Patent: Sep. 13, 2022

(54) INTELLIGENT COMPLETION OF A MULTILATERAL WELLBORE WITH A WIRED SMART WELL IN THE MAIN BORE AND WITH A WIRELESS ELECTRONIC FLOW CONTROL NODE IN A LATERAL WELLBORE

(71) Applicant: Halliburton Energy Services, Inc., Houston, TX (US)

(72) Inventors: Michael Linley Fripp, Carrollton, TX (US); Stephen Michael Greci, Little Elm, TX (US); Thomas Jules Frosell, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/622,734

(22) PCT Filed: Jun. 11, 2019

(86) PCT No.: PCT/US2019/036580
§ 371 (c)(1),
(2) Date: Dec. 13, 2019

(87) PCT Pub. No.: WO2020/018201
PCT Pub. Date: Jan. 23, 2020

(65) Prior Publication Data

US 2021/0355790 A1 Nov. 18, 2021

Related U.S. Application Data

(60) Provisional application No. 62/700,795, filed on Jul. 19, 2018.

(51) Int. Cl.
*E21B 43/08* (2006.01)
*E21B 41/00* (2006.01)
(Continued)

(52) U.S. Cl.
CPC ..... *E21B 41/0035* (2013.01); *E21B 34/066* (2013.01); *E21B 41/0085* (2013.01);
(Continued)

(58) Field of Classification Search
CPC ..... E21B 43/08; E21B 41/0035; E21B 34/066
See application file for complete search history.

(56) References Cited

U.S. PATENT DOCUMENTS 5,706,896 A 1/1998 Tubel et al.
6,768,700 B2 7/2004 Veneruso et al.
(Continued)

FOREIGN PATENT DOCUMENTS

WO WO 2018/052462 A1 3/2018

OTHER PUBLICATIONS

International Search Report and The Written Opinion of the International Search Authority, or the Declaration, dated Oct. 2, 2019, PCT/US2019/036580, 13 pages, ISA/KR.

*Primary Examiner* — Giovanna Wright
(74) *Attorney, Agent, or Firm* — Haynes and Boone, LLP

(57) ABSTRACT

A completion assembly to aid in fluid control in a multilateral wellbore includes a plurality of sand screen assemblies, each sand screen assembly having a wireless adjustable electronic flow control node disposed along a sand screen base pipe to control fluid flow between the sand screen assembly and the wellbore annulus. Each electronic flow control node includes a valve that can be adjusted by an electric actuator powered by a power harvesting mechanism disposed in a flow path of the completion assembly. A wireless transmitter receives a control signal to control the electric actuator, opening or closing the valve to control flow in the lateral wellbore. A wired controller in the main wellbore is disposed for transmitting wireless signals across
(Continued)

a junction assembly in the wellbore to the sand screen assembly electronic flow control nodes.

20 Claims, 12 Drawing Sheets

(51) Int. Cl.

| | |
|---|---|
| ***E21B 34/06*** | (2006.01) |
| ***E21B 43/10*** | (2006.01) |
| ***E21B 43/12*** | (2006.01) |
| ***E21B 43/14*** | (2006.01) |
| ***E21B 47/12*** | (2012.01) |

(52) U.S. Cl.
CPC ..... *E21B 43/08* (2013.01); *E21B 43/10* (2013.01); *E21B 43/12* (2013.01); *E21B 43/14* (2013.01); *E21B 47/12* (2013.01); *E21B 2200/02* (2020.05)

(56) References Cited

U.S. PATENT DOCUMENTS

| | | | | |
|---|---|---|---|---|
| 8,237,585 | B2 | 8/2012 | Zimmerman | |
| 9,644,458 | B2 * | 5/2017 | Vu | E21B 17/043 |
| 2004/0163804 | A1 | 8/2004 | Bode et al. | |
| 2007/0227727 | A1 | 10/2007 | Patel et al. | |
| 2009/0008078 | A1 * | 1/2009 | Patel | E21B 41/0035 166/50 |
| 2010/0243243 | A1 | 9/2010 | Chen et al. | |
| 2010/0314109 | A1 * | 12/2010 | Garcia | E21B 43/04 166/278 |
| 2011/0067886 | A1 | 3/2011 | Moen | |
| 2013/0048280 | A1 * | 2/2013 | Techentien | E21B 43/12 166/278 |
| 2014/0338922 | A1 * | 11/2014 | Lopez | E21B 34/066 166/373 |
| 2016/0168984 | A1 | 6/2016 | Fripp et al. | |
| 2017/0130564 | A1 | 5/2017 | Steele et al. | |
| 2019/0010783 | A1 | 1/2019 | Frosell et al. | |
| 2019/0055814 | A1 | 2/2019 | Frosell et al. | |

* cited by examiner

INTELLIGENT COMPLETION OF A MULTILATERAL WELLBORE WITH A WIRED SMART WELL IN THE MAIN BORE AND WITH A WIRELESS ELECTRONIC FLOW CONTROL NODE IN A LATERAL WELLBORE

CROSS-REFERENCE TO RELATED APPLICATION

The present application is a U.S. National Stage Patent Application International Patent Application No. PCT/US2019/036580, filed Jun. 11, 2019, which claims priority to U.S. Provisional Application No. 62/700,795, filed Jul. 19, 2018, the benefit of which is claimed and the disclosures of which are incorporated by reference in their entirety.

BACKGROUND

In the course of completing an oil and/or gas well, a string of production tubing can be run into the wellbore. During production of the formation fluid, formation sand may be swept into the flow path. The formation sand tends to be relatively fine sand that can erode production components in the flow path.

When formation sand is expected to be encountered in formation fluid, a lower completion assembly may be installed in the production zone between the formation and the production tubing. The lower completion assembly typically includes a plurality of sand screen assemblies joined together end-to-end. Each sand screen assembly generally includes a perforated base pipe surrounded by a sand screen to filter fines from the formation fluid. Typically, the sand screen is spaced radially apart from the base pipe to form a flow path therebetween to direct filtered formation fluid from the sand screen to the perforations of the base pipe. To better manage flow formation fluid into the base pipe, at least one and often a plurality of inflow control devices ("ICDs") are deployed along the flow path of each sand screen assembly. ICDs are designed to improve completion performance and efficiency by choking inflow along the length of a lower completion assembly in order to balance the inflow. Differences in influx from the reservoir can result in premature water/gas breakthrough, leaving valuable resources in the ground. Traditionally, ICDs are operated utilizing electric or hydraulic control lines extending from the surface, or through use of equipment lowered from the surface, or are otherwise autonomous in their operation, with no external control. Thus, in production systems where it is difficult to deploy control lines, such as in multilateral wellbores where it is difficult to run control lines past or through a junction assembly, the ability to individually control formation fluid production flow at the granular level of individual sand screen assemblies can be lost.

The base pipes of adjacent sand screen assemblies are coupled together to form a joint and allow fluid communication between adjacent sand screen assembly base pipes, forming a conduit for flow of produced formation fluids. A packer is customarily set upstream of the sand screen assemblies to seal off the annulus in the production zone where formation fluids flow into the production tubing.

Often, the annulus around the sand screen assemblies can then be "gravel packed" with a relatively coarse sand (or gravel) which acts as a filter to reduce the amount of fine formation sand reaching the screens. The packing sand is pumped down the work string in a slurry of carrier fluid, such as water and/or gel and fills the annulus around the sand screens. In well installations in which the screen assemblies are suspended in an uncased open bore, the sand or gravel pack may serve to support the surrounding unconsolidated formation. In certain lower production assemblies, a washpipe may be positioned within the base pipe and extend below the sand screens in order to deliver the gravel pack slurry to the wellbore annulus. However, during the gravel packing process, a premature loss of the carrier fluid into the formation, known as leak-off, can occur, resulting in the formation of sand bridges in the annulus about the screening. With a premature loss of carrier fluid, incomplete packing around the sand screen and reduce the filtering efficiency of the gravel pack. Thus, in some sand screen assemblies, in order to overcome this packing sand bridging problem, one or more longitudinally extending shunt tubes may be employed, where the shunt tubes extend adjacent the sand screen section, with opposite ends of each shunt tube projecting outwardly beyond the active filter portion of the sand screen section. Shunt tubes of adjacent sand screen assemblies may be joined to one another to form a shunt path extending along at least a portion of the length of the lower production assembly. The shunt path operates to permit the inflowing packing sand/gel slurry to bypass any sand bridges that may be formed and permit the slurry to enter the screen/casing or screen/open hole annulus beneath a sand bridge, thereby forming the desired sand pack beneath it.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
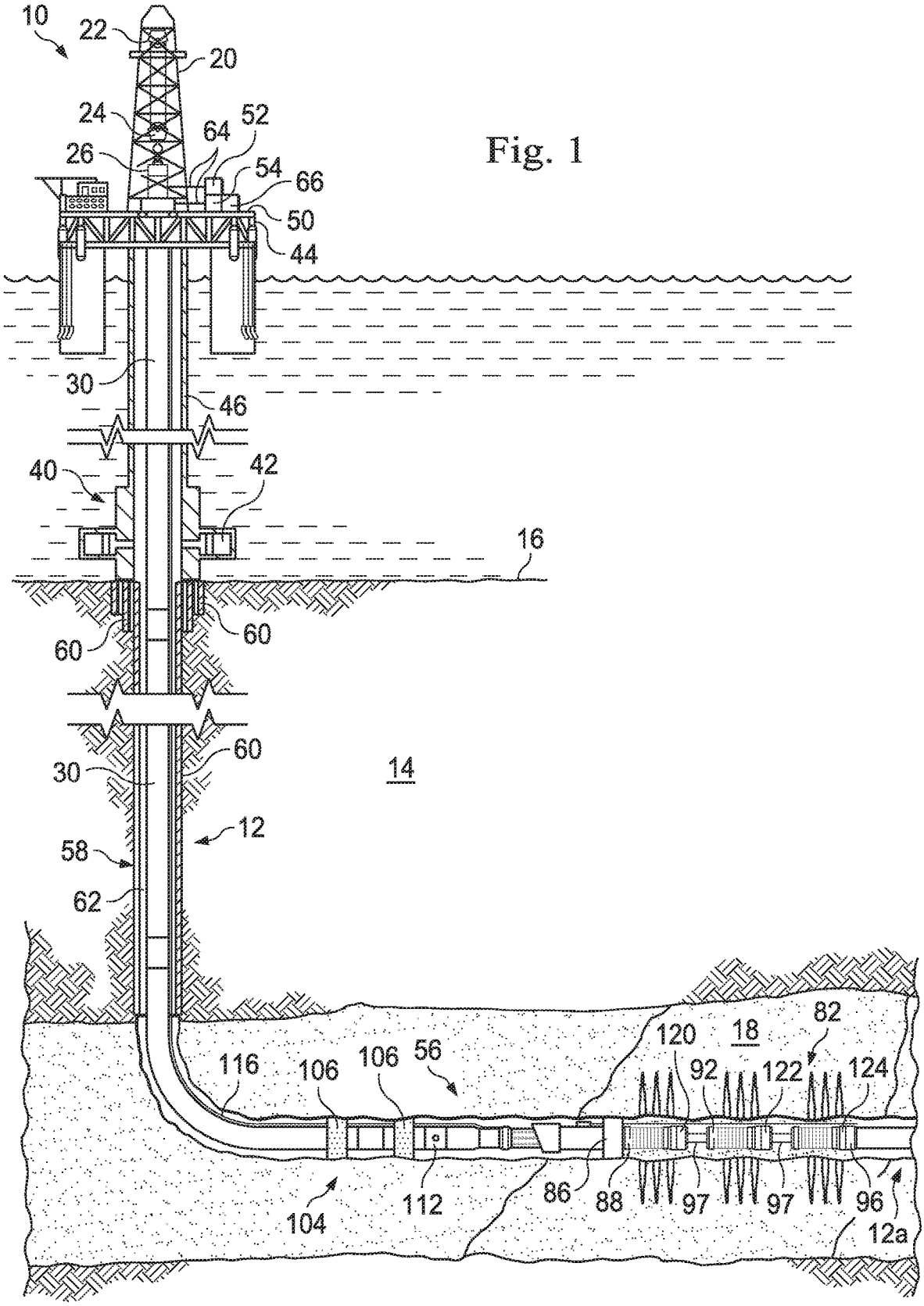
FIG. 1 is an elevation view in partial cross-section of a wellbore production system utilizing electronic flow control nodes.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover, even though a figure may depict a horizontal wellbore or a vertical wellbore, unless indicated otherwise, it should be understood by those skilled in the art that the apparatus according to the present disclosure is equally well-suited for use in wellbores having other orientations including, deviated wellbores, multilateral wellbores, or the like. Likewise, unless otherwise noted, even though a figure may depict an offshore operation, it should be understood by those skilled in the art that the apparatus according to the present disclosure is equally well-suited for use in onshore operations and vice-versa.

Generally, a lower completion assembly made up of at least two sand screen assemblies is provided, namely a first or upper sand screen assembly and a second or lower sand screen assembly. At least one sand screen assembly includes a perforated base pipe having a sand screen disposed around a portion of the base pipe to form a sand screen flow path between the sand screen and the base pipe. An adjustable electronic flow control node is positioned along the base pipe. The electronic flow control node has a valve body in which is defined an electronic flow control node flow path that is fluidically connected to a base pipe perforation. The electronic flow control node further includes a power harvesting mechanism disposed along a flow path of the electronic flow control node or of the sand screen assembly. The electronic flow control node includes a valve disposed along the electronic flow control node flow path and moveable between at least a first position and a second position so as to adjust flow along the electronic flow control node flow path. The valve is actuated by an electric actuator that is powered by the power harvesting mechanism. Finally, the electronic flow control node includes a wireless transmitter for controlling the electric actuator. The electronic flow control nodes may be used to inject a working fluid into the wellbore annulus around the respective sand screen assembly. For example, a gravel pack slurry, acidizing treatment, hydraulic fracturing fluid or cake breaking fluid may be injected into the wellbore annulus. Where two or more sand screen assemblies, and particularly where a plurality of sand screen assemblies, are interconnected to form a lower completion string, the respective electronic flow control nodes may be operated in concert to achieve a particular objective. For example, the electronic flow control nodes may be sequentially opened and/or closed along the string. One or more sand screen assemblies may include a shunt system generally having at least one tube, such as a transport tube or a packing tube, extending along the base pipes, where the packing tube may include a plurality of nozzles. In such embodiments, the electronic flow control nodes may be utilized to control flow through the shunt system. Because they can be effectively adjusted utilizing a wireless signal, such as an electromagnetic signal or a pressure signal transmitted through a wellbore from a spaced apart controller, a single electronic flow control node may replace a plurality of ICDs, it being understood that in the prior art, a plurality of ICDs may be required to address a variety of different flow scenarios. Thus, in some embodiments, a string of sand screen assemblies may include at least one sand screen assembly with an electronic flow control node fluidically coupled to a perforated base pipe, and a plurality of sand screen assemblies without perforated base pipes or ICDs, where the sand screen flow paths from of the plurality of sand screen assemblies are in fluid communication with the electronic flow control node of the one sand screen assembly. In such case, the electronic flow control node may be utilized to control flow from multiple sand screen assemblies. In wellbore systems having one or more lateral wellbores branching off from a main wellbore, sand screen assemblies having electronic flow control nodes may be deployed in the lateral wellbore or downstream or down hole from a junction assembly and wirelessly controlled during injection and/or production flow from a wired controller positioned upstream or up hole of the junction assembly, such as along a portion of the upper completion assembly. This avoids the need for wired control of the lateral wellbore sand screen assemblies and the difficulty of deploying such control cabling through the junction assembly.

Turning to FIG. 1, shown is an elevation view in partial cross-section of a wellbore production system 10 utilized to complete wells intended to produce hydrocarbons from wellbore 12 extending through various earth strata in an oil and gas formation 14 located below the earth's surface 16. Wellbore 12 may be formed of a single or multiple bores, extending into the formation 14, and disposed in any orientation, such as the horizontal wellbore 12*a* illustrated in FIG. 1. Formation 14 includes production zones 18 from which hydrocarbons are produced.

Production system 10 includes a rig or derrick 20. Rig 20 may include a hoisting apparatus 22, a travel block 24, and a swivel 26 for raising and lowering casing, drill pipe, coiled tubing, production tubing, other types of pipe or tubing strings 30 or other types of conveyance vehicles such as wireline, slickline, and the like. In FIG. 1, shown is a substantially tubular, axially extending work string or production tubing 30, formed of a plurality of pipe joints coupled together end-to-end supporting a completion assembly as described below.

Rig 20 may be located proximate to or spaced apart from wellhead 40, such as in the case of an offshore arrangement as shown in FIG. 1. One or more pressure control devices 42, such as blowout preventers (BOPs), and other equipment associated with drilling or producing a wellbore may also be provided at wellhead 40 or elsewhere in production system 10.

For offshore operations, as shown in FIG. 1, rig 20 may be mounted on an oil or gas platform 44, such as the offshore platform as illustrated, semi-submersibles, drill ships, and the like (not shown). Although production system 10 of FIG. 1 is illustrated as being a marine-based production system, production system 10 of FIG. 1 may be deployed on land. In any event, for marine-based systems, one or more subsea conduits or risers 46 extend from deck 50 of platform 44 to a subsea wellhead 40. Tubing string 30 extends down from rig 20, through subsea conduit 46 and BOP 42 into wellbore 12.

A working or service fluid source 52, such as a storage tank or vessel, may supply, via flow lines 64, a working fluid to equipment disposed in wellbore 12, such as subsurface equipment 56. Working fluid source 52 may supply any fluid utilized in wellbore operations, including without limitation, gravel packing slurry, acidizing fluid, liquid water, steam or some other type of fluid.

Production system 10 may generally be characterized as having a pipe system 58. For purposes of this disclosure, pipe system 58 may include casing, risers, tubing, drill strings, completion or production strings, subs, heads or any other pipes, tubes or equipment that couples or attaches to the foregoing, such as tubing string 30, conduit 46, and casing. In this regard, pipe system 58 may include one or more casing strings 60 that may be cemented in wellbore 12, such as the surface, intermediate and production casings, 60 shown in FIG. 1. An annulus 62 is formed between the walls of sets of adjacent tubular components, such as concentric casing strings 60 or the exterior of tubing string 30 and the inside wall of wellbore 12 or casing string 60, as the case may be. While wellbore 12 is shown as uncased in the production zone 18 and along the entire depicted portion of horizontal wellbore 12*a*, all or a portion of wellbore 12 and/or horizontal wellbore 12*a* may be cased as well and the disclosure is not limited in that regard.

Production fluids and other debris returning to surface 16 from wellbore 12 are directed by a flow line 64 to storage tanks 54 and/or processing systems 66.

As shown in FIG. 1, subsurface equipment 56 is illustrated as completion equipment and tubing string 30 in fluid communication with the completion equipment 56 is illustrated as production tubing 30. Although completion equipment 56 can be disposed in a wellbore 12 of any orientation, for purposes of illustration, completion equipment 56 is shown disposed in a substantially horizontal portion of wellbore 12 and includes a lower completion assembly 82 having various tools such as a packer 86, a sand screen assembly 88, a sand screen assembly 92, a sand screen assembly 96 and a packer 98. In embodiments where lower completion assembly 82 is deployed in a cased wellbore, an additional packer, such as packer 86, would be deployed at the distal end of the lower completion assembly. In the illustrated embodiment, packer 86 is generally located adjacent the upstream or proximal end of a production zone 18 and packer 98 is generally located adjacent the downstream or distal end of a production zone 18. Sand screen assemblies 88, 92 and 96 each may include a shunt tube system 97.

In the illustrated embodiment, one or more of sand screen assemblies 88, 92 and 96 include an adjustable electronic flow control node 120, 122, 124, respectively, that can be utilized to inject working fluids from working fluid source 52 into the annulus 62 around sand screen assemblies 88, 92 and 96. In some embodiments, one or more electronic flow control nodes 120, 122, 124 may be utilized to control flow of fluid through shunt tube systems 97.

Disposed in wellbore 12 at the lower end of tubing string 30 is an upper completion assembly 104 that includes various tools such as a packer 106, and a fluid flow control module 112.

Extending uphole from upper completion assembly 104 are one or more lines 116, such as hydraulic tubing, pressurized fluid tubing, electric cable and the like which extend to the surface 16 and can be utilized for control of upper completion assembly 104 and lower completion assembly 82. In one or more embodiments, lines 116 extent to fluid flow control module 112 and utilized to transmit control signals to and from fluid flow control module 112. Fluid flow control module 112 may be utilized to wirelessly communicate with electronic flow control nodes 102, 122, and 124, such as through electromagnetic signals or pressure signals.

Figure 2:
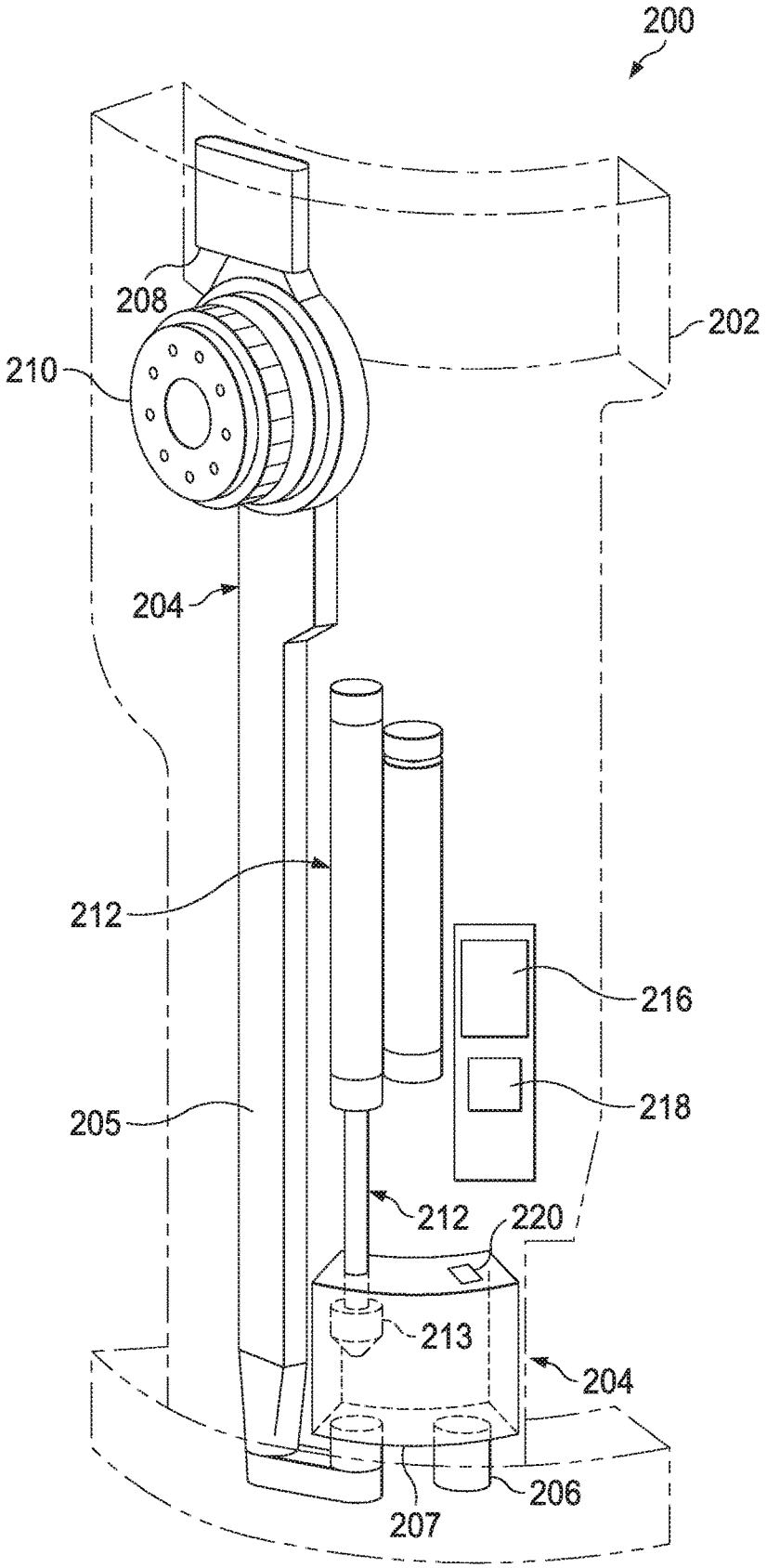
FIG. 2 is a perspective view of an adjustable electronic flow control nodes.

With reference to FIG. 2, an adjustable electronic flow control node, such as electronic flow control nodes 120, 122, and 124 of FIG. 1, is illustrated in more detail and generally depicted as electronic flow control node 200. electronic flow control node 200 generally includes an electronic flow control node valve body 202 having an electronic flow control node flow path 204 defined therethrough extending between fluid ports 206, 208. A power harvesting mechanism 210 may be disposed along the electronic flow control node flow path 204. Flow path 204 may be defined by one or more channels or ducts 205 formed in electronic flow control node valve body 202, and may likewise include one or more manifolds 207 interconnecting channels 205 and fluid ports 206, 208. In some embodiments, power harvesting mechanism 210 is a turbine generator or blade generator that can be actuated by fluid flow along flow path 204. In other embodiments, power harvesting mechanism 210 may be disposed to be actuated by fluid flow external of electronic flow control node valve body 202, such as production flow flowing past electronic flow control node 200. Also disposed along flow path 204 between fluid ports 206, 208 is an adjustable valve 212 which may be utilized to form a restriction in channel 205 to control flow along flow path 204. Valve 212 is not limited to a particular type of valve, but can be any valve known to persons of ordinary skill in the art. While not limiting the foregoing, in some embodiments, valve 212 may be a ball valve, while in other embodiments, valve 212 may be a plunger valve, while is still other embodiments, valve 212 may be a gate valve. In the illustrated embodiment, valve 212 is shown as having a drive mechanism 214 to actuate a movable plunger 215 that can translate linearly to alter the restriction. In any event, valve 212 is generally movable between a first position and a second position so as to adjust flow along the electronic flow control node flow path 204. In this regard, a first position may be fully closed and a second position may be open to some degree to allow fluid to flow along flow path 204. Valve 212 may be adjusted to alter flow along flow path 204 for different operations. For example, valve 212 may be in a fully open position to allow electronic flow control node to be utilized in fluid injection procedures, such as acidizing, hydraulic fracturing, gravel packing and the like. Thereafter, when valve 212 is used for production, flow along flow path 204 may be decreased by closing valve 212 to form a partial restriction in channel 205, thus controlling formation fluid flow along flow path 204. In any event, valve 212 is controlled by a drive mechanism 214 such an electric actuator. Electric actuator 214 may generally be powered by power harvesting mechanism 210 controlled by control electronics 216. Control electronics 216 include a wireless transmitter 218 for receiving wireless control signals as described herein. As used herein, wireless transmitter is meant to be any device that can receive a wireless signal and/or transmit a wireless signal, and is not limited to a particular type of wireless signal. In one or more preferred embodiments, power harvesting mechanism 210, valve 212, electric actuator 214, and control electronics 216 are all carried on electronic flow control node valve body 202 or otherwise packaged therewith. In one or more embodiments, wireless transmitter 218 may be further disposed for transmitting wireless signals from a sensor 220 disposed to measure an environmental condition adjacent electronic flow control node 200. Without limiting the disclosure, sensor 220 may be a temperature sensor, a pressure sensor, a flow sensor, or an optic sensor. In one or more embodiments, sensor 220 likewise may be carried on electronic flow control node valve body 202, while in other embodiments, sensor 220 may be separate from electronic flow control node valve body 202. Sensor 220 allows conditions around electronic flow control node 200 to be monitored and wirelessly transmitted to a controller, such as fluid flow control module 112 of FIG. 1, thereby permitting adjustment of valve 212 as desired based on the measured conditions by sensor 220. In some embodiments, electronic flow control node valve body 202 may be a sleeve shape (see FIG. 6) while in other embodiments, electronic flow control node valve body 202 may have a smaller profile (see FIG. 7). In some embodiments, electronic flow control node valve body 202 may have an electronic flow control node flow path 204 with multiple fluid ports 206 and/or multiple fluid ports 208. In yet another embodiment, electronic flow control node 200 may have two flow paths defined therein and interconnecting with fluid port 206, each of the flow paths terminating in a fluid port 208 so that flow to one or the other of fluid ports 208 may be selectively determined by valve 212.

Figure 3A:
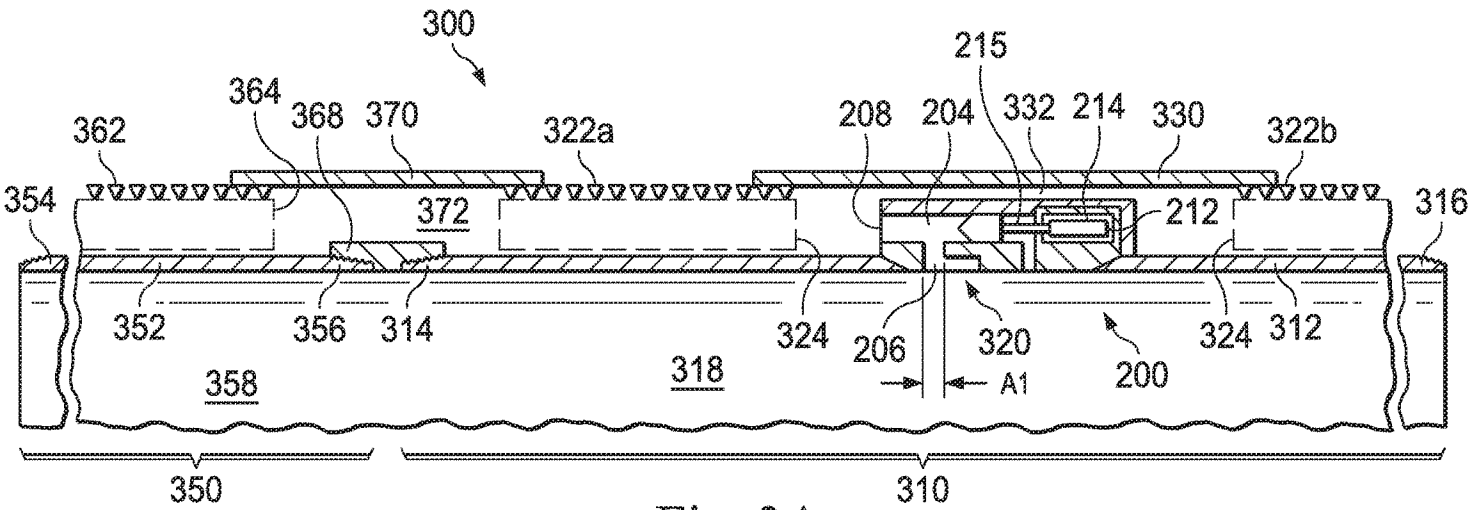
FIG. 3A is an elevation view in cross-section of a lower completion assembly with one embodiment of an electronic flow control node.
Figure 3B:
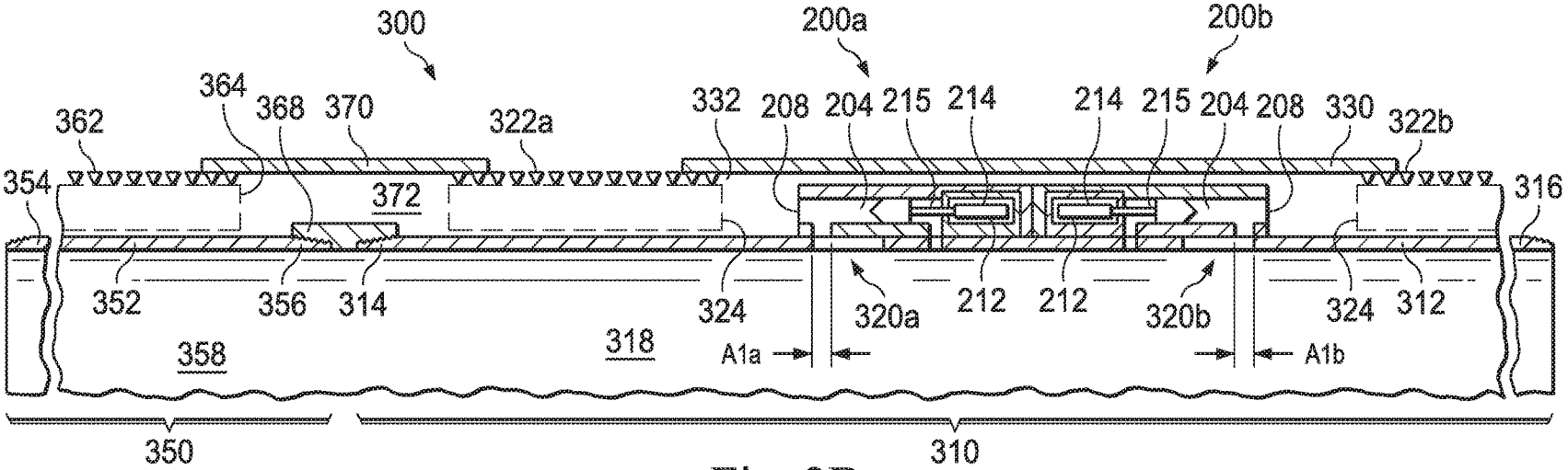
FIG. 3B is an elevation view in cross-section of a lower completion assembly with one embodiment of an electronic flow control node.

Turning to FIGS. 3A and 3B, cross-sectional views of embodiments of a lower completion assembly 300 with one or more electronic flow control nodes 200 as described in FIG. 2 are illustrated. Lower completion assembly 300 is generally comprised of at least one electronic flow control node sand screen assembly 310. Sand screen assembly 310 has a base pipe 312 extending between a first end 314 and a second end 316 and defining an interior flow passage 318 therein. Base pipe 312 further includes at least one perforation 320 having a cross-sectional opening area A1. In other embodiments, base pipe 312 may include multiple perforations. A sand screen 322 is disposed around a portion of the base pipe 312 and forms a sand screen flow path or passage 324 between the sand screen 322 and the base pipe 312. Sand screen 322 can be any filter media known in the industry and is not intended to be limited by the disclosure. In one embodiment, a sand screen assembly 310 may include two or more sand screens 322 deployed along base pipe 312, such as is illustrated as sand screens 322*a* and 322*b*. Although sand screen 322 is illustrated as spaced apart from perforation 320, perforation 320 may also be adjacent sand screen 322. Sand screen assembly 310 further includes electronic flow control node 200. As described above, electronic flow control node 200 includes at least one valve 212, but may include two or more valves 212. Alternatively, as needed, rather than multiple valves 212 in a single electronic flow control node 200, multiple electronic flow control nodes 200 may be utilized as needed. In any event, FIG. 3A illustrates an electronic flow control node 200 with a single valve 212, while in FIG. 3B, multiple electronic flow control nodes 200 are illustrated, namely a first electronic flow control node 200*a* and a second electronic flow control node 200*b*. Valve 212 is not limited to a particular type of valve, but can be any valve known to persons of ordinary skill in the art. While not limiting the foregoing, in some embodiments, valve 212 may be a ball valve, while in other embodiments, valve 212 may be a plunger valve, while is still other embodiments, valve 212 may be a gate valve. In the illustrated embodiment, valve 212 is shown as having a drive mechanism 214 in the form of an electric actuator. In the illustrated embodiment, electric actuator 214 actuates a movable plunger 215 that can translate linearly to alter the restriction. In any event, valve 212 is generally movable between a first position and a second position so as to adjust flow along the electronic flow control node flow path 204. In this regard, a first position may be fully closed and a second position may be open to some degree to allow fluid to flow along flow path 204. Valve 212 may be adjusted to alter the cross-sectional area of flow path 204, permitting different flow rates for different operations. electronic flow control node 200 is deployed along base pipe 312 adjacent perforation 320 such that flow path 204 of electronic flow control node 200 is in fluid communication with the interior flow passage 318 via aligned fluid port 206 and perforation 320. In the illustrated embodiment, flow path 204 of electronic flow control node 200 is also in fluid communication with the sand screen flow paths 324 via fluid port 208. In the case where base pipe 312 includes multiple perforations 320, electronic flow control node 200 may likewise include multiple fluid ports 206 along flow path 204. In other embodiments with multiple perforations 320 in base pipe 312, such as is shown in FIG. 3B, a separate electronic flow control node 200 can be deployed for each perforation 320. Specifically, as illustrated in FIG. 3B, a first electronic flow control node 200*a* may communicate with a first perforation 320*a* while a second electronic flow control node 200*b* may communicate with a second perforation 320*b*. In such case, one perforation may be used for a first task, such as an injection perforation to inject a working fluid into an annulus adjacent a sand screen, while another perforation may be utilized for a second task, such as a production perforation to control flow of formation fluid into the base pipe 312. In such embodiments, the cross-sectional areas Ala of the injection perforation may be smaller than the cross-sectional area Alb of the production perforation. Thus, flow path 204 restrictions can be adjusted accordingly for the operation with which the electronic flow control node 200 is used.

In each of FIGS. 3A and 3B, a connecting sleeve 330 is illustrated. Connecting sleeve 330 is generally disposed around a portion of the base pipe 312 and spaced apart therefrom to form a connecting sleeve flow path 332 between the connecting sleeve 330 and the base pipe 312. In the illustrated embodiment of FIG. 3, electronic flow control node 200 is spaced apart from and generally positioned along base pipe 312 between two sand screens 322, depicted as screens 322*a* and 322*b*. Connecting sleeve 330 extends between sand screens 322*a*, 322*b* and over electronic flow control node 200 so that sleeve flow path 332 fluidically couples sand screen flow paths 324 of sand screens 322*a*, 322*b*. Moreover, electronic flow control node flow path 204 is in fluid communication with the fluidically coupled flow paths 324 and 332. As such, electronic flow control node 200 can be utilized to control fluid flow from a plurality of sand screens 322.

In FIGS. 3A and 3B, electronic flow control node sand screen assembly 310 is shown coupled to an additional sand screen assembly 350. In the illustrated embodiment, sand screen assembly 350 does not include base pipe perforations or apertures as does sand screen assembly 310. Sand screen assembly 350 has an unperforated base pipe 352 extending between a first end 354 and a second end 356 and defining an interior flow passage 358 therein. A sand screen 362 is disposed around a portion of the base pipe 352 and forms a sand screen flow path or passage 364 between the sand screen 362 and the base pipe 352. Sand screen 362 can be any filter media known in the industry and is not intended to be limited by the disclosure. In one embodiment, a sand screen assembly 350 may include two or more sand screens 362 deployed along base pipe 352. As shown, the first end 314 of base pipe 312 is coupled to the second end 356 of base pipe 352 to form a joint 368 therebetween. A connecting sleeve 370 extends between sand screen 322 of electronic flow control node sand screen assembly 310 and sand screen 362 of sand screen assembly 350 so that connecting sleeve 370 spans joint 368 between the sand screen assemblies, thereby forming a connecting sleeve flow path 372 between the connecting sleeve 370 and base pipe 312 and 352 so as to fluidically couple sand screen flow path 364 with sand screen flow path 324. In this embodiment, electronic flow control node 200 can be utilized to control formation fluid flow passing into sand screen assembly 350.

Figure 4:
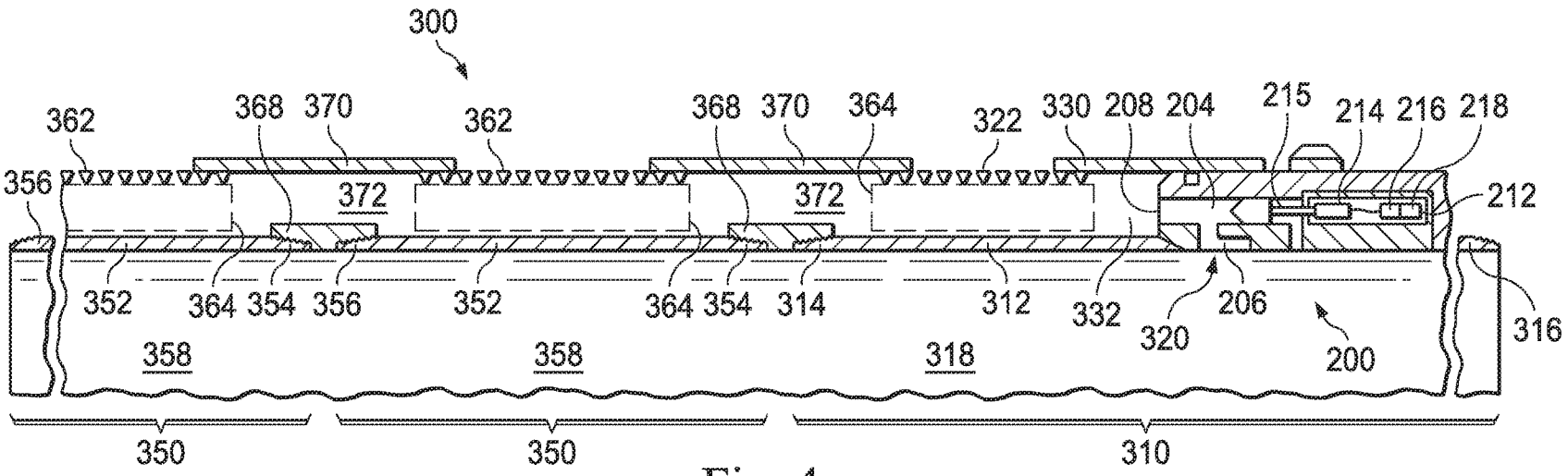
FIG. 4 is an elevation view in cross-section of a lower completion assembly with an electronic flow control node.

FIG. 4 is similar to FIG. 3A, but in FIG. 4, perforation 320 and electronic flow control node 200 are spaced apart from sand screen 322. In this embodiment, connecting sleeve 330 extends between electronic flow control node 200 and sand screen 322 so that the sleeve flow path 332 of connecting sleeve 330 fluidically couples sand screen flow path 324 and electronic flow control node flow path 204. Of course, in other embodiments, electronic flow control node 200 may be positioned under sand screen 322 along a flow path 324 or otherwise positioned adjacent sand screen 322 so that fluid port 208 of electronic flow control node is fluidically coupled to flow path 324.

Lower completion assembly 300 is generally comprised of at least one electronic flow control node sand screen assembly 310. Sand screen assembly 310 has a base pipe 312 extending between a first end 314 and a second end 316 and defining an interior flow passage 318 therein. Base pipe 312 further includes at least one perforation 320 having a cross-sectional opening area A1. In other embodiments, base pipe 312 may include multiple perforations. A sand screen 322 is disposed around a portion of the base pipe 312 and forms a sand screen flow path or passage 324 between the sand screen 322 and the base pipe 312. Sand screen 322 can be any filter media known in the industry and is not intended to be limited by the disclosure. In one embodiment, a sand screen assembly 310 may include two or more sand screens 322 deployed along base pipe 312, such as is illustrated as sand screens 322*a* and 322*b*. Although sand screen 322 is illustrated as spaced apart from perforation 320, perforation 320 may also be adjacent sand screen 322. Sand screen assembly 310 further includes electronic flow control node 200. As described above, electronic flow control node 200 includes a valve 212. Valve 212 is not limited to a particular type of valve, but can be any valve known to persons of ordinary skill in the art. While not limiting the foregoing, in some embodiments, valve 212 may be a ball valve, while in other embodiments, valve 212 may be a plunger valve, while is still other embodiments, valve 212 may be a gate valve. In the illustrated embodiment, valve 212 is shown as having a drive mechanism 214 in the form of an electric actuator to actuate a movable plunger 215 that can translate linearly to alter the restriction. In any event, valve 212 is generally movable between a first position and a second position so as to adjust flow along the electronic flow control node flow path 204. In this regard, a first position may be fully closed and a second position may be open to some degree to allow fluid to flow along flow path 204. Valve 212 may be adjusted to alter the cross-sectional area of flow path 204, permitting different flow along flow path 204 rates for different operations. electronic flow control node 200 is deployed along base pipe 312 adjacent perforation 320 such that flow path 204 of electronic flow control node 200 is in fluid communication with the interior flow passage 318 via aligned fluid port 206 and perforation 320. In the illustrated embodiment, flow path 204 of electronic flow control node 200 is also in fluid communication with the sand screen flow path 324 via fluid port 208. In the case where base pipe 312 includes multiple perforations 320, electronic flow control node 200 may likewise include multiple fluid ports 206 along flow path 204. In other embodiments with multiple perforations 320 in base pipe 312, a separate electronic flow control node 200 can be deployed for each perforation 320. In such case, one perforation may be used as an injection perforation to inject a working fluid into an annulus adjacent a sand screen and another perforation may be utilized as a production perforation to control flow of formation fluid into the base pipe 312. In such embodiments, the cross-sectional areas A1 of the injection perforation may be larger than the cross-sectional area A1 of the production perforation. Thus, flow path 204 restrictions can be adjusted accordingly for the operation with which the electronic flow control node 200 is used.

A connecting sleeve 330 is provided and generally disposed around a portion of the base pipe 312 and spaced apart therefrom to form a connecting sleeve flow path 332 between the connecting sleeve 330 and the base pipe 312. Connecting sleeve 330 extends between sand screens 322*a*, 322*b* and over electronic flow control node 200 so that sleeve flow path 332 fluidically couples sand screen flow paths 324 of sand screens 322*a*, 322*b*. Moreover, electronic flow control node flow path 204 is in fluid communication with the fluidically coupled flow paths 324 and 332. As such, electronic flow control node 200 can be utilized to control fluid flow from a plurality of sand screens 322.

Electronic flow control node sand screen assembly 310 is shown coupled to an additional sand screen assembly 350. In the illustrated embodiment, sand screen assembly 350 does not include base pipe perforations or apertures as does sand screen assembly 310. Sand screen assembly 350 has an unperforated base pipe 352 extending between a first end 354 and a second end 356 and defining an interior flow passage 358 therein. A sand screen 362 is disposed around a portion of the base pipe 352 and forms a sand screen flow path or passage 364 between the sand screen 362 and the base pipe 352. Sand screen 362 can be any filter media known in the industry and is not intended to be limited by the disclosure. In one embodiment, a sand screen assembly 350 may include two or more sand screens 362 deployed along base pipe 352. As shown, the first end 314 of base pipe 312 is coupled to the second end 356 of base pipe 352 to form a joint 368 therebetween. A connecting sleeve 370 extends between sand screen 322 of electronic flow control node sand screen assembly 310 and sand screen 362 of sand screen assembly 350 so that connecting sleeve 370 spans joint 368 between the sand screen assemblies, thereby forming a connecting sleeve flow path 372 between the connecting sleeve 370 and base pipe 312 and 352 so as to fluidically couple sand screen flow path 364 with sand screen flow path 324. In this embodiment, electronic flow control node 200 can be utilized to control formation fluid flow passing into sand screen assembly 350.

Figure 5A:
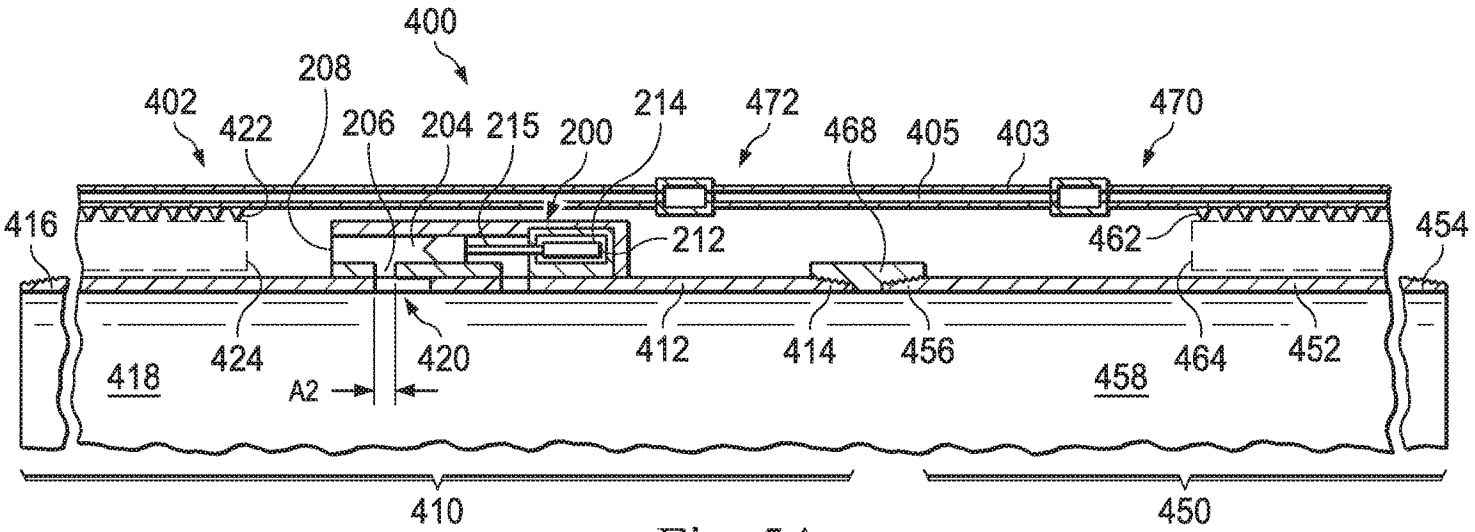
FIG. 5A is an elevation view in cross-section of a lower completion assembly with a shunt tube assembly and an electronic flow control node.
Figure 5B:
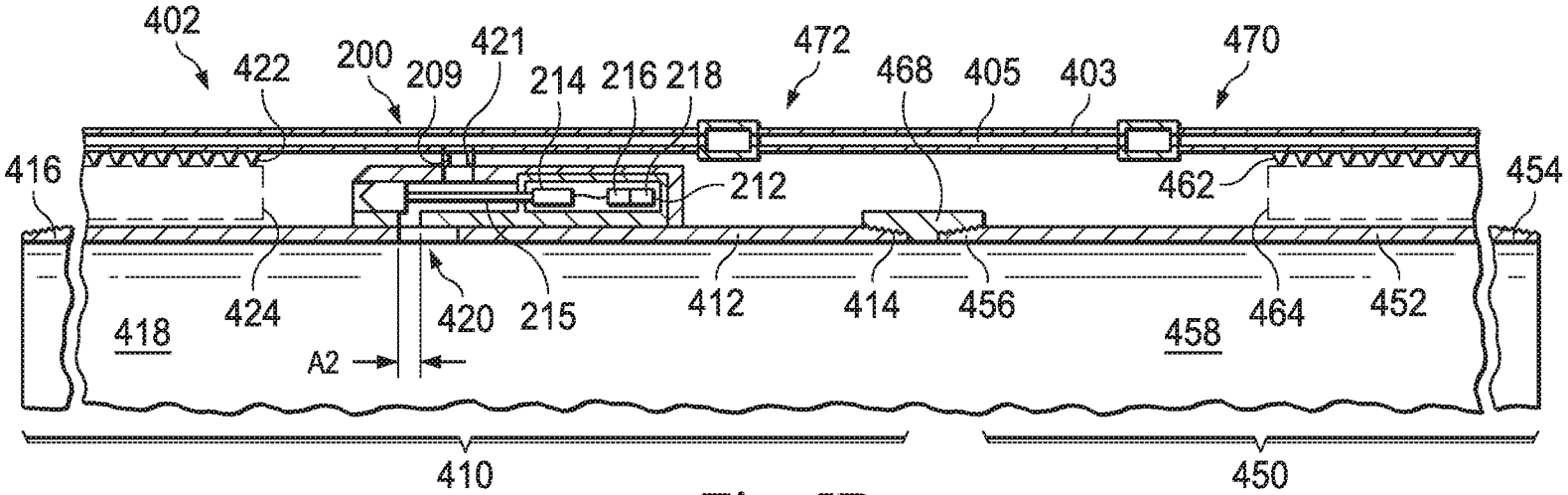
FIG. 5B is an elevation view in cross-section of a lower completion assembly with a shunt tube assembly and an electronic flow control node.

Turning to FIGS. 5A and 5B, embodiments of a lower completion assembly 400 with an electronic flow control node 200 (as described above) and a shunt tube assembly 402 adjacent electronic flow control node 200 are illustrated. Shunt tube assembly 402 generally includes at least one tube 403 having a flow path 405 defined therein. Lower completion assembly 400 is generally comprised of at least one electronic flow control node sand screen assembly 410. Sand screen assembly 410 has a base pipe 412 extending between a first end 414 and a second end 416 and defining an interior flow passage 418 therein. Base pipe 412 further includes at least one perforation 420 having a cross-sectional opening area A2. A sand screen 422 is disposed around a portion of the base pipe 412 and forms a sand screen flow path or passage 424 between the sand screen 422 and the base pipe 412. Sand screen 422 can be any filter media known in the industry and is not intended to be limited by the disclosure. In one embodiment, a sand screen assembly 410 may include two or more sand screens 422 deployed along base pipe 412. In the illustrated embodiment, sand screen 422 is illustrated as adjacent perforation 420 of base pipe 412.

Sand screen assembly 410 further includes electronic flow control node 200 deployed along base pipe 412 adjacent perforation 420 such that flow path 204 of electronic flow control node 200 is in fluid communication with the interior flow passage 418 via aligned fluid port 206 and perforation 420. In the illustrated embodiments, electronic flow control node 200 is positioned adjacent sand screen 422 so that flow path 204 of electronic flow control node 200 may also be in fluid communication with the sand screen flow path 424 via fluid port 208. As described above, electronic flow control node 200 includes a valve 212. Valve 212 is not limited to a particular type of valve, but can be any valve known to persons of ordinary skill in the art. While not limiting the foregoing, in some embodiments, valve 212 may be a ball valve, while in other embodiments, valve 212 may be a plunger valve, while is still other embodiments, valve 212 may be a gate valve. In the illustrated embodiment, valve 212 is shown as having a drive mechanism 214, such as an electric actuator, to actuate a movable plunger 215 that can translate linearly to alter the restriction. In any event, valve 212 is generally movable between at least a first position and a second position so as to adjust flow along the electronic flow control node flow path 204. In this regard, a first position may be fully closed and a second position may be open to some degree to allow fluid to flow along flow path 204. Valve 212 may be adjusted to alter the cross-sectional area of flow path 204, permitting different flow along flow path 204 rates for different operations.

In FIGS. 5A and 5B, electronic flow control node sand screen assembly 410 is shown coupled to an additional sand screen assembly 450. While sand screen assembly 450 does not include base pipe perforations or apertures as does sand screen assembly 410, in other embodiments, sand screen assembly 450 can be an electronic flow control node sand screen assembly as described herein. In any event, sand screen assembly 450 has a base pipe 452 extending between a first end 454 and a second end 456 and defining an interior flow passage 458 therein. A sand screen 462 is disposed around a portion of the base pipe 452 and forms a sand screen flow path or passage 464 between the sand screen 462 and the base pipe 452. Sand screen 462 can be any filter media known in the industry and is not intended to be limited by the disclosure. In one embodiment, a sand screen assembly 450 may include two or more sand screens 462 deployed along base pipe 452. As shown, the first end 414 of base pipe 412 is coupled to the second end 456 of base pipe 452 to form a joint 468 therebetween. Sand screen assembly 450 also includes a shunt tube assembly 470. In the illustrated embodiment, a jumper tube 472 fluidically connects shunt tube assembly 402 with shunt tube assembly 470 across joint 468. While shunt tube assemblies 402, 470 are illustrated as extending along their respective electronic flow control node sand screen assemblies 410, 450 external of sand screens 422, 462, one or both of shunt tube assemblies 402, 470 could extend between sand screens 422, 462 and their respective base pipes 412, 452.

In FIG. 5B, electronic flow control node 200 deployed along base pipe 412 includes a first fluid port 206 aligned with perforation 420 of base pipe 412, a second fluid port 208 that is in fluid communication with the sand screen flow path 424, and a third fluid port 209 that is in fluid communication with a perforation 421 in tube 403 of shunt tube assembly 402. In the illustrated embodiment of FIG. 5B, valve 212 is generally movable between at least a first position, a second position and a third position. In a first position, flow through first fluid port 206 is blocked and valve 212 is fully closed. In a second position, valve 212 may be open to some degree to allow fluid to flow along flow path 204 to second fluid port 208, thereby establishing fluid communication between interior flow passage 418 and sand screen flow path 424 via fluid port 208. In this second position, flow through port 209 is blocked. In a third position which is illustrated in FIG. 5B, valve 212 may be open to some degree to allow fluid to flow along flow path 204 to third fluid port 209, thereby establishing fluid communication between interior flow passage 418 and shunt tube flow path 405 via fluid port 209. In this third position, flow through port 208 is blocked. Thus, valve 212 is at least a three-position valve in the illustrated embodiment. In any event, electronic flow control node 200 of FIG. 5B can be utilized to control flow through shunt tube assembly 402 and sand screen assembly 410.

Figure 6:
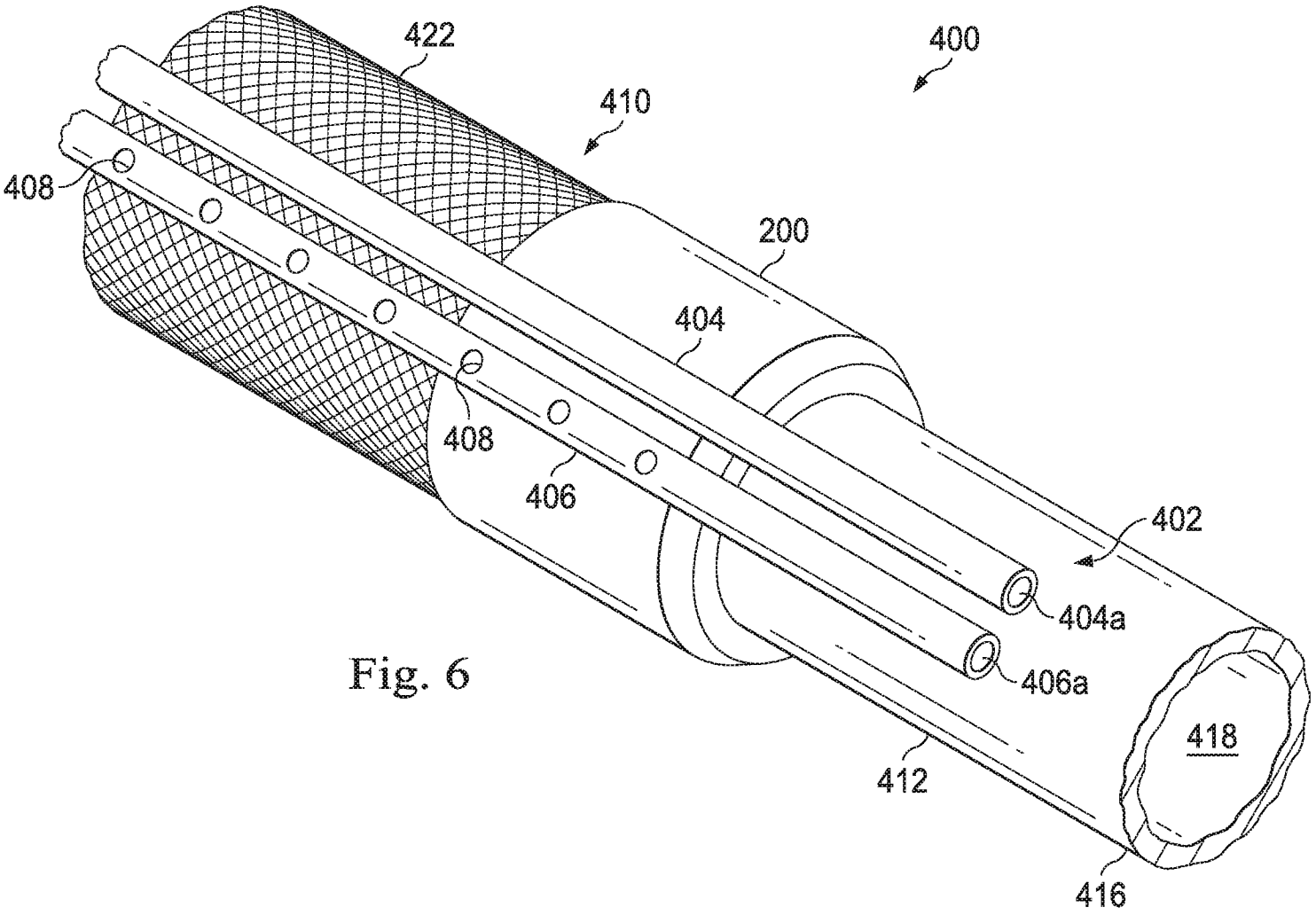
FIG. 6 is a perspective view of a lower completion assembly with a shunt tube assembly and an electronic flow control node.
Figure 7:
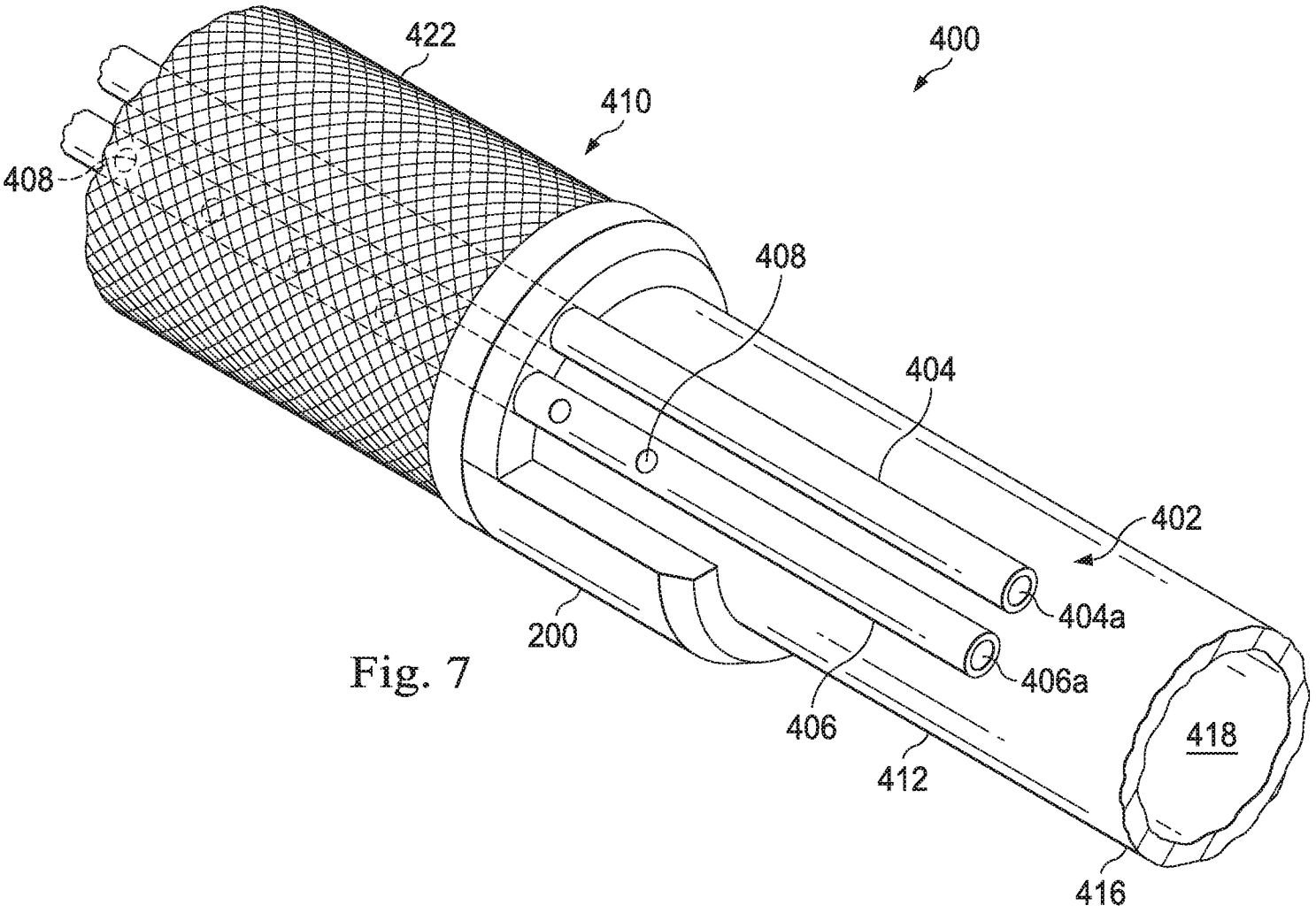
FIG. 7 is a perspective view of a lower completion assembly with a shunt tube assembly and an electronic flow control node.

In FIGS. 6 and 7, shunt tube assembly 402 is shown extending adjacent electronic flow control node 200 and sand screen 422. In one or more embodiments, shunt tube assembly 402 may include at least one of a transport tube 404 or a packing tube 406 or both, each tube having a passageway 404*a*, 406*a*, respectively, defined therein, the packing tube 406 further including a plurality of nozzles 408 through which a working fluid may be injected about sand screen assembly 410. In FIG. 6, transport tube 404 and packing tube 406 are shown extending over electronic flow control node 200, wherein electronic flow control node 200 extends around base pipe 412, while in FIG. 7, transport tube 404 and packing tube 406 are shown extending alongside electronic flow control node 200 where electronic flow control node 200 does not fully extend around base pipe 412. One or both shunt tubes 404, 406 may likewise be positioned radially inward of sand screen 422 or radially inward of sand screen 422. In some embodiments, transport tube 404 may be positioned radially inward of the sand screen 422, while packing tube 406 is positioned radially outward of the sand screen assembly 422. In some embodiments, transport tube 404 may be positioned radially outward of the sand screen 422, while packing tube 406 is positioned radially inward of the sand screen assembly 422. In one or more embodiments, the shunt tube assembly 402 may comprise only a packing tube 406 with a plurality of nozzles 408. In such embodiments, the packing tube 406 may be disposed radially inward of sand screen 422, such as is shown in FIG. 7, or radially outward of sand screen 422, such as is shown in FIG. 6. It will be appreciated that in such embodiments, the need for a transport tube 404 may be eliminated by the presence of an electronic flow control node 200 to deliver fluid to packing tube 406 from interior flow passage 418.

Figure 8:
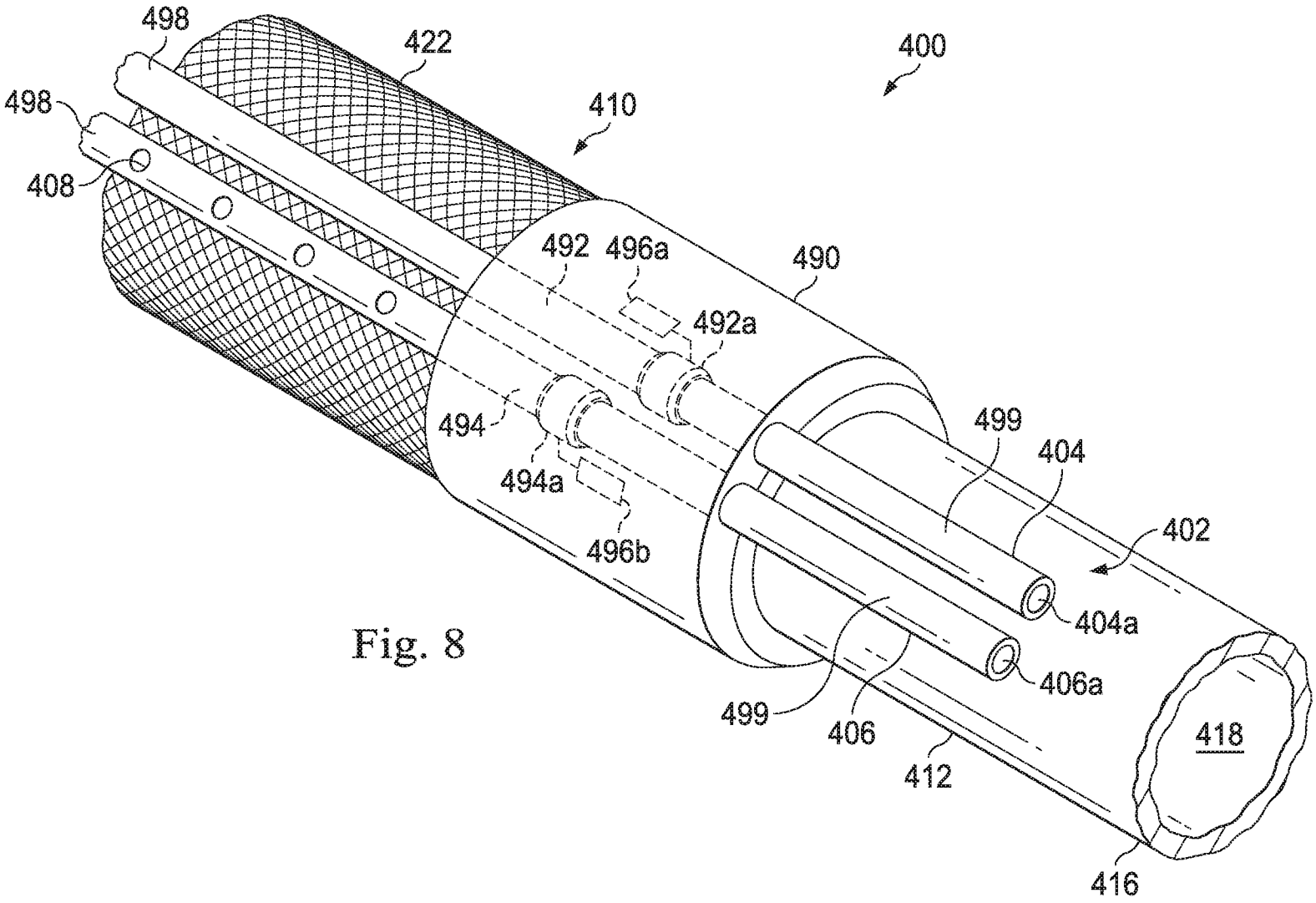
FIG. 8 is a perspective view of a lower completion assembly with a shunt tube assembly controlled by electronic flow control nodes.

In FIG. 8, an electronic flow control node 490 is depicted for use in controlling fluid flow through one or more of the tubes 404, 406 comprising the shunt tube assembly 402. In one or more embodiments, shunt tube assembly 402 may include a transport tube 404 and a packing tube 406, each tube having a passageway 404*a*, 406*a*, respectively, defined therein, the packing tube 406 further including a plurality of nozzles 408 through which a working fluid may be injected about sand screen assembly 410. In one embodiment, as illustrated, an electronic flow control node 490 is disposed to control flow through each of transport tube 404 and packing tube 406. Generally, electronic flow control node 490 includes the same components and operates similar to electronic flow control node 200 described above, however, in the illustrated embodiment, electronic flow control node 490 includes two valves. Specifically, as shown, electronic flow control node 490 includes two flow paths 492, 494, each with an adjustable valve 492*a*, 494*a* disposed therealong. Each adjustable valve 492*a*, 494*a* is operable by an electric actuator or drive mechanism 496*a*, 496*b*. electronic flow control node 490 may be disposed between an upstream portion 498 and a downstream portion 499 of each of transport tube 404 and packing tube 406. As such, flow path 492 fluidically interconnects portions 498 and 499 of transport tube 404, and flow path 494 fluidically interconnects portions 498 and 499 of packing tube 406.

It will be appreciated that in some embodiments, an electronic flow control node 200 may be used with a shunt tube assembly 402 without also having an electronic flow control node 200 deployed to control flow into a sand screen assembly. Thus, certain sand screen assemblies may only include an electronic flow control node 200 to control flow through the shunt tube assembly 402. For example, the sand screen assembly in FIG. 8 may not include an electronic flow control node for formation fluid flow.

Figure 9A:
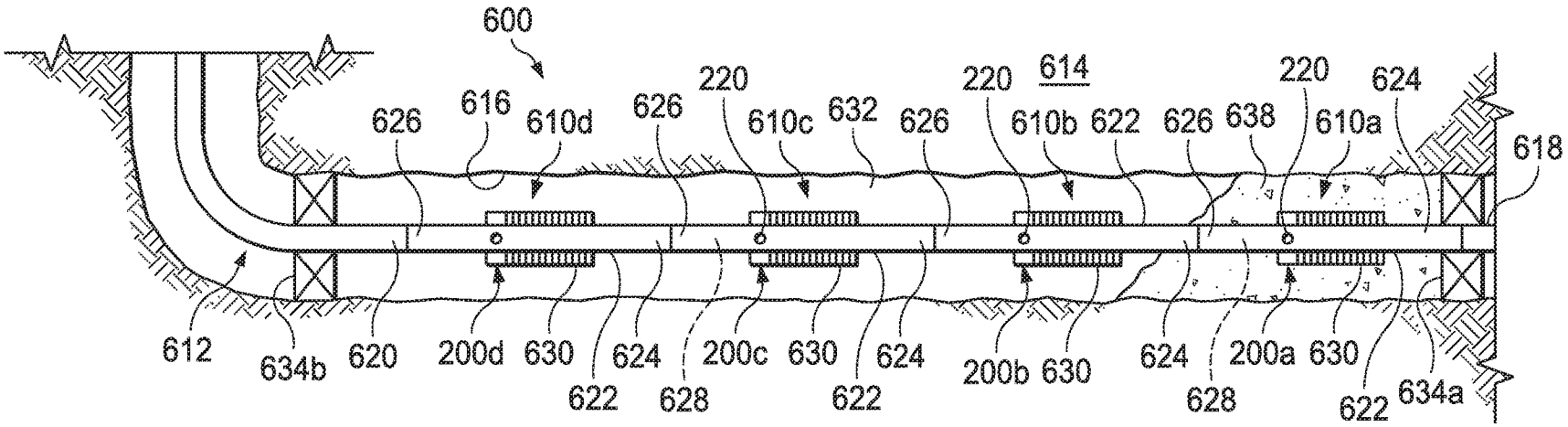
FIGS. 9A-9C are elevation views in cross-section of a lower completion assembly demonstrating gravel packing using successive electronic flow control nodes.
Figure 9B:
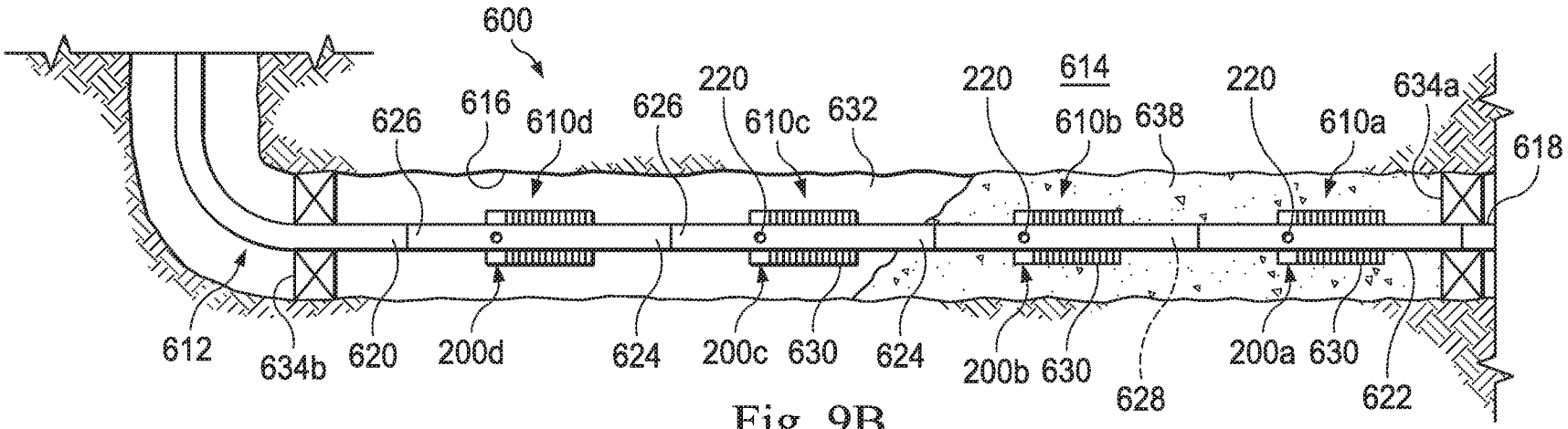
Figure 9C:
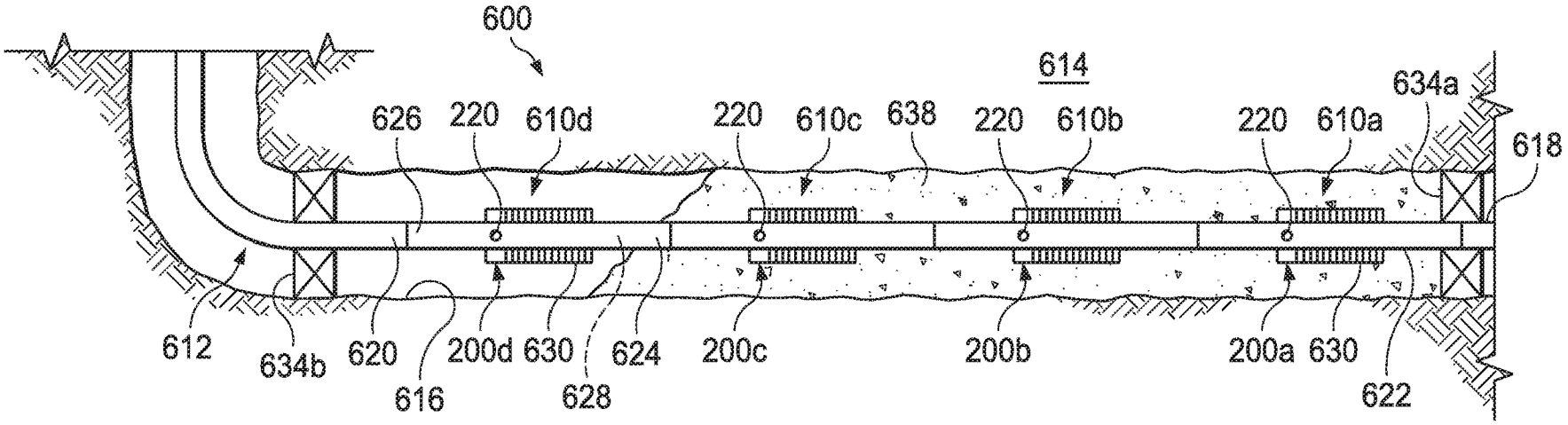

Turning to FIGS. 9*a*, 9*b* and 9*c*, a completion assembly 600 having a plurality of interconnected electronic flow control node sand screen assemblies 610 is shown. In particular, a production string 612 may include may include successive, fluidically interconnected sand screen assemblies 610*a*, 610*b*, 610*c*, 610*d* as shown, adjacent a formation production zone 614 along a wellbore 616. String 612 may be characterized as having a downstream or distal end 618 and an upstream or proximal end 620. Each sand screen assembly 610 includes an electronic flow control node 200 as described herein, shown as electronic flow control nodes 200*a*, 200*b*, 200*c*, 200*d*. Each sand screen assembly 610 has a base pipe 622 extending between a first end 624 and a second end 626 and defining an interior flow passage 628 therein. Each sand screen assembly 610 further includes a sand screen 630 disposed around a portion of the base pipe 622. The electronic flow control node 200 of each sand screen assembly 610 provides a flow path between the interior flow passage 628 of base pipe 622 and the exterior of base pipe 622, whether adjacent the sand screen 630 or spaced apart from sand screen 630. In this regard, each electronic flow control node 200 may be specifically dedicated to injecting a working fluid into the annulus 632 about completion assembly 600. In other embodiments, electronic flow control node 200 may be utilized to both inject a working fluid into annulus 632 and to control flow of formation fluids from annulus 632 into base pipe 622. A sealing mechanism 634*a*, such as a packer or other devices well known in the art, may be deployed downstream of the lowermost electronic flow control node along a production string section adjacent production zone 614, in this case depicted as electronic flow control node 200*a*, adjacent distal end 618 of a production zone portion of string 612. Likewise, a sealing mechanism 634*b* may be deployed upstream of upper most electronic flow control node along a production string section adjacent production zone 614, in this case depicted as electronic flow control node 200*d*, adjacent the proximal end 620 of a production zone portion of string 612. Of course, persons of skill in the art will appreciate that sealing mechanisms 634 may be placed anywhere along string 612 as desired for zonal sealing and the disclosure is not limited in this regard. In one or more embodiments, the production zone 614 may be defined as the formation between first and second sealing mechanisms 634*a*, 634*b* along a production string 614.

In any event, the electronic flow control nodes 200 of sand screen assemblies 610*a*, 610*b*, 610*c*, 610*d* may be selectively controlled to inject a working fluid into the annulus 632 for a particular operation. In one embodiment, the electronic flow control nodes 200 may be sequentially opened, starting from the distal most sand screen assembly 610*a*, to gravel pack annuls 632. It will be appreciated that by performing a gravel pack operation utilizing electronic flow control nodes 200 as described herein, the need for a washpipe at the end of string 612, such as is used in the prior art, is eliminated since the selective operation of the electronic flow control nodes 200 can be utilized to simulate the function of a washpipe.

Thus, a gravel packing operation may be conducted wherein tubing string 612 having at least two successive electronic flow control nodes 200 is positioned adjacent production zone 614 in a wellbore 616. A sealing mechanism 634*a* may be deployed downstream of the lowermost electronic flow control node 200 and a sealing mechanism 634*b* may be deployed upstream of the uppermost electronic flow control node 200. In one or more embodiments, string 612 is run into wellbore 616 and deployed with all electronic flow control nodes 200 in a closed configuration, whereby the respective electronic flow control node valves are closed, blocking flow along the electronic flow control node flow path as described above. Once string 612 is in position, then the lower most electronic flow control node 200, in this case, electronic flow control node 200*a* of sand screen assembly 610*a*, may be actuated to open the electronic flow control node valve of sand the lower most sand screen assembly 610, in this case, screen assembly 610*a*. A gravel pack slurry is then pumped down string 612 to the actuated electronic flow control node 200*a* and is directed through electronic flow control node 200*a* and injected by electronic flow control node 200*a* into annulus 632 adjacent sand screen assembly 610*a* to form a gravel pack 638 about sand screen assembly 610*a*. Once the gravel pack 638 about sand screen assembly 610*a* has been built, as shown in FIG. 9A, then electronic flow control node 200*b* of sand screen assembly 610*b* is opened and the procedure is repeated, thereby extending the gravel pack 638 to the annulus adjacent sand screen assembly 610*b*, as shown in FIG. 9B Likewise, once the gravel pack 638 about sand screen assembly 610*b* has been built, then electronic flow control node 200*c* of sand screen assembly 610*c* is opened and the procedure is repeated, thereby extending the gravel pack 638 to the annulus adjacent sand screen assembly 610*c*, as shown in FIG. 9C. The procedure can be repeated sequentially moving upstream for as many electronic flow control node 200 sand screen assemblies 610 as may be included in string 612. It should be understood that not all sand screen assemblies comprising string 612 need be electronic flow control node sand screen assemblies. Thus, non-electronic flow control node sand screen assemblies may be interconnected in string 612. In any event, FIGS. 9A, 9B and 9C illustrate the successive buildup of gravel pack 638 from the distal end 618 of string 612 towards the proximal end 620 of string 612 or otherwise, within the annulus 632 between first sealing mechanism 634*a* and second sealing mechanism 634*b*.

While in some embodiments, once injection through electronic flow control node 200*a* is complete, electronic flow control node 200*a* may remain in the open position to continue to drain the slurry fluid from the gravel pack 638, in other embodiments, once a slurry injection through electronic flow control node 200*a* is complete, the electronic flow control node 200*a* may be closed. These described selective operations of electronic flow control node 200*a* apply to all electronic flow control nodes 200 in string 612.

In one or more embodiments, a sensor, such as sensor 220 described above in FIG. 2, may be utilized to monitor the formation of gravel pack 638. For example, once a particular threshold fluid pressure is reached about sand screen assembly 610*a* then electronic flow control node 200*b* may be opened. In another embodiment, once fluid flow through electronic flow control node 200*a* rate drops below a predetermined threshold, then electronic flow control node 200*b* may be opened. The same is true for measured pressure or other conditions measured by an adjacent sensor 220.

As will be appreciated, the sensor 220 may be utilized to generate a signal that is wirelessly transmitted to a control station upstream of sand screen assembly 610*a*, and a corresponding control signal may be transmitted back sand screen assembly 610*a* to close electronic flow control node 200*a*, or alternatively transmitted to sand screen assembly 610*b* to open electronic flow control node 200*b*. Alternatively, a timing signal locally generated by the electronic flow control nodes 200 may be utilized to control the opening of electronic flow control nodes 200 during fluid injection operations. For example, electronic flow control node 200*a* may be opened, and after a predetermined above of time, electronic flow control node 200*b* may be opened. Likewise, each upstream electronic flow control node 200 may be sequentially or selectively opened. In other embodiments, a synchronization timing signal may be transmitted to each electronic flow control node 200 in the string prior to initiation of the process.

In other embodiments, rather than injecting a gravel pack slurry, other working fluids may be injected. Moreover, the while one method may sequentially open and/or close electronic flow control nodes 200 along string 612, in other embodiments, electronic flow control nodes 200 may be opened or closed in any desired order. Furthermore, the foregoing applies whether working fluids are being injected into wellbore annulus 632 or formation fluids are passing through sand screens 630 into flow passage 628. Thus, control signals may be wirelessly transmitted to a plurality of electronic flow control nodes 200 to control production of formation fluids along the string.

Figure 10:
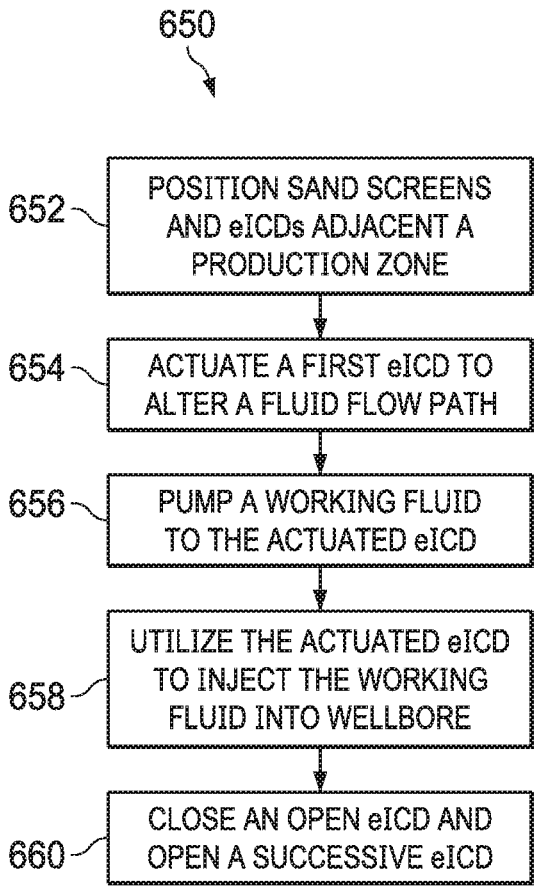
FIG. 10 is a flowchart of a method for injecting a fluid into a wellbore annulus using successive electronic flow control nodes.

In FIG. 10, a method 650 for controlling fluid flow in a wellbore utilizing electronic flow control nodes 200 positioned adjacent sand screen assemblies is depicted. In one or more embodiments, the method 650 may be utilized to inject a fluid into a wellbore annulus 632. In one or more embodiments, the method 650 may be utilized to inject a fluid into a wellbore annulus 632 using successive electronic flow control nodes. In this regard, the method 650 may be utilized to gravel pack a wellbore annulus. In one or more embodiments, the method 650 may be utilized to control flow of production fluid from a wellbore annulus.

In a first step 652, a completion assembly having one or more electronic flow control nodes and one or more sand screen assemblies is positioned adjacent a production zone in a wellbore. In one or more embodiments, the completion assembly includes a string of successive, fluidically interconnected sand screen assemblies, each sand screen assembly carrying an electronic flow control node with a valve movable between at least an open and closed position. The valve may be positioned in a select open or closed position as desired for the operation. The completion assembly may include a sealing mechanism positioned below the lowermost electronic flow control node and a sealing mechanism positioned above the uppermost electronic flow control node in a production string segment, thereby defining a production zone between the sealing mechanisms.

In step 654, at least one electronic flow control node is actuated to alter a flow path through the actuated electronic flow control node. In one or more embodiments, the electronic flow control node is actuated to open or close the valve of the electronic flow control node. In one or more embodiments, the electronic flow control node is actuated to adjust the valve of the electronic flow control node, thereby controlling fluid flow through an associated sand screen assembly. In one or more embodiments, the electronic flow control node is actuated to open the valve of the actuated electronic flow control node where the electronic flow control node was deployed with the valve in a closed position. In this regard, a signal may be transmitted to actuate the electronic flow control node. In some embodiments, the signal may be transmitted wirelessly. In some embodiments, the signal may be transmitted wirelessly from a main wellbore to a lateral wellbore in which the electronic flow control node is positioned. In some embodiments, a first signal may be transmitted to actuate a first electronic flow control node in a string of electronic flow control nodes. In some embodiments, a plurality of electronic flow control nodes may be actuated by a signal, while in other embodiments, a separate signal may be transmitted to individually actuate each electronic flow control node in a plurality of electronic flow control nodes so that the electronic flow control nodes may be actuated in a select order.

In step 656, a working fluid is pumped down a tubing string to the completion assembly, and in particular, to the actuated electronic flow control node. Where the method 650 is gravel packing, step 656 may include pumping a gravel packing slurry down the tubing string to the completion assembly. In other embodiments, other types of working fluid may be pumped down the tubing string. For example, during acidizing treatment, an acidizing working fluid may be pumped down the tubing string to the electronic flow control nodes. Those skilled in the art will appreciate that step 656 may be omitted in instances where the electronic flow control nodes are actuated to control production flow as opposed to working fluid injection.

In step 658, the working fluid is directed through the activated electronic flow control node and injected into the wellbore annulus around the completion assembly. In one or more embodiments where the working fluid is a slurry, step 658 includes directing slurry flow through the electronic flow control node from the completion assembly into the wellbore annulus around a sand screen of the completion assembly.

In one or more embodiments, a plurality of electronic flow control nodes may be successively actuated and utilized for the controlling fluid flow. Thus, in step 660, a first open electronic flow control node may be closed and a second closed electronic flow control node may be opened. The first electronic flow control node may be at a lower or more distal location in the wellbore than the second electronic flow control node, which is located upstream of the first electronic flow control node in the wellbore. This step may be repeated for successive electronic flow control nodes. Thus, the second open electronic flow control node may be closed and a third closed electronic flow control node may be opened, where the second electronic flow control node may be at a lower or more distal location in the wellbore than the third electronic flow control node, which is located upstream of the second electronic flow control node in the wellbore. In gravel packing operations, by repeating this step 660 multiple times for successive electronic flow control nodes beginning at a downstream electronic flow control node and successively actuating upstream electronic flow control nodes, a gravel pack may be gradually built up around the sand screen assemblies of a completion assembly from a distal location to a proximate location. Step 660 may include measuring a characteristic of the completion assembly having one or more electronic flow control nodes and actuating an electronic flow control node based on the measured characteristic. In one or more embodiments, a first electronic flow control node is utilized to inject a gravel pack slurry into a wellbore annulus adjacent a production zone and a first sensor is utilized to measure the buildup of a gravel pack at a first location. Once a threshold measurement characteristic is measured by the first sensor, the first electronic flow control node is closed and a successive second electronic flow control node is opened. The second electronic flow control node is utilized to inject a gravel pack slurry into a wellbore annulus adjacent the production zone and a second sensor is utilized to measure the buildup of a gravel pack at a second location upstream of the first location. Once a threshold measurement characteristic is measured by the second sensor, the second electronic flow control node is closed and a successive third electronic flow control node is opened. The third electronic flow control node is utilized to inject a gravel pack slurry into a wellbore annulus adjacent the production zone and a third sensor is utilized to measure the buildup of a gravel pack at a third location upstream of the second location. Once a threshold measurement characteristic is measured by the third sensor, the third electronic flow control node is closed and a successive fourth electronic flow control node is opened. This process may be repeated until a gravel pack is built up in the wellbore annulus from a distal location to a proximal location.

While the foregoing describes a method 650 for controlling fluid flow in a wellbore to inject a fluid into a wellbore annulus 632, in other embodiments, the method 650 may be utilized to control flow of production fluid from a wellbore annulus. It will be appreciated that in such case, steps 656 and 658 may be eliminated. Rather, production flow from a desired portion of a production zone can be controlled by opening and closing electronic flow control nodes as desired. In one embodiment, successive electronic flow control nodes deployed adjacent the production zone may be actuated. The successive electronic flow control nodes may be opened and closed progressively down a wellbore annulus or up a wellbore annulus as desired.

Figure 11:
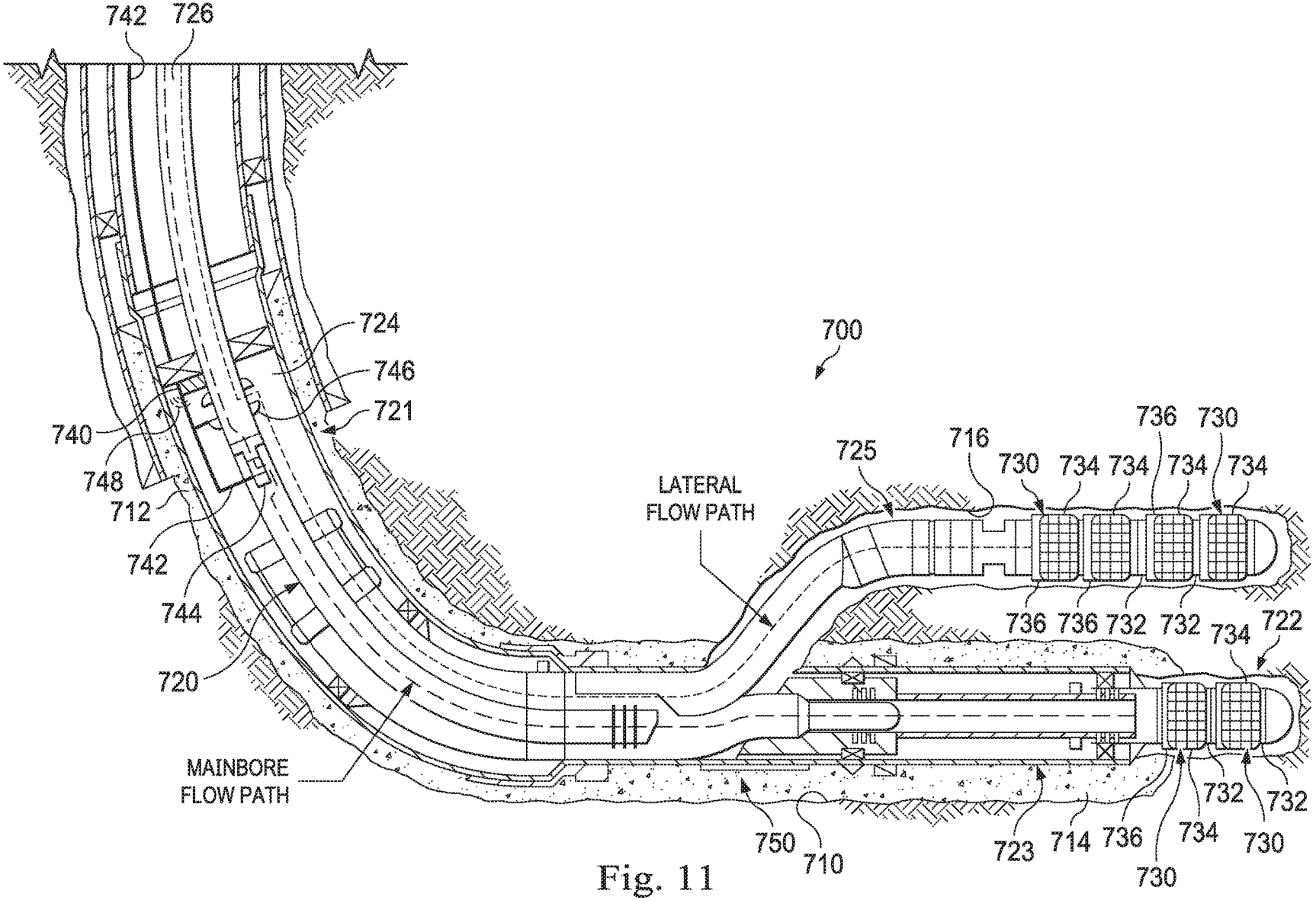
FIG. 11 is an elevation view in cross-section of a multilateral well completion assembly with electronic flow control nodes.

Turning to FIG. 11, in other embodiments, electronic flow control nodes 200 may be utilized to better control flow in multilateral wellbores, such as multilateral wellbore 700. Multilateral wellbore 700 generally may include a main wellbore 710 having an upper end 712 and a lower end 714 and a lateral wellbore 716. As shown, an elongated tool string 720 is deployed in multilateral wellbore 700. Tool string 720 generally has a distal portion 722 and a proximal portion 724 and a flow passage 726 defined therein and includes an upper completion assembly 721, a lower completion assembly 723 and a lateral completion assembly 725. One or more electronic flow control node sand screen assemblies 730 of the type described above may be disposed along the distal portion 722 of the elongated tool string 720 and in fluid communication with the flow passage 726, either as part of the lateral completion assembly, the lower completion assembly or both. Each electronic flow control node sand screen assembly 730 includes a base pipe 732 and a sand screen 734 disposed around a portion of the base pipe and forming a sand screen flow path between the sand screen and the base pipe. Each electronic flow control node sand screen assembly 730 includes an electronic flow control node 736, such as the electronic flow control nodes 200 described above.

As shown, tool string 720 includes a wired controller 740 which may be connected to a location upstream, such as the surface (see FIG. 1) by one or more control lines 742. Control lines 742 may be electric, hydraulic, optic or of other types known in the art. An upstream valve 744 may be used to control formation fluid flow from electronic flow control node sand screen assemblies 730 in the lower main wellbore 710, while an upstream valve 746 may be used to control formation fluid flow from electronic flow control node sand screen assemblies 730 in the lateral wellbore 716. In one or more embodiments, valves 744 and 746 may be wired and controlled by controller 740 as shown. In addition, controller 740 may be configured to transit wireless control signals 748 down wellbore 700 to the electronic flow control node sand screen assemblies 730 to selectively control inflow of formation fluids into flow passage 726. Controller 740 may also be configured to receive wireless signals transmitted from electronic flow control node sand screen assemblies 730 as described above, such as signals associated with sensors 220 (see FIG. 2). In one or more embodiments, controller 740 may include an electromagnetic transmitter or a pressure transducer for transmitting and/or receiving wireless signals 748.

It will be appreciated that in multilateral wellbores 700 such as described, tool string 720 may include a junction assembly 750 through or past which it is difficult to pass control lines, such as control line 742. By utilizing wirelessly controlled electronic flow control nodes in sand screen assemblies downstream of junction assembly 750, either in the lower main wellbore 710 or the lateral wellbore 716 or both, more precise control of formation fluid flow can be achieved than simply utilizing valves 744 and 746.

Thus, a wellbore completion assembly has been described. The completion assembly may include a base pipe having at least one perforation therein and extending between a first end and a second end; a sand screen disposed around a portion of the base pipe and forming a sand screen flow path between the sand screen and the base pipe; an adjustable electronic inflow control device (electronic flow control node) disposed along the base pipe, the electronic flow control node comprising a valve body having an electronic flow control node flow path defined therethrough fluidically connecting the sand screen flow path and the perforation; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism disposed along a completion assembly flow path defined between an exterior of the sand screen and an interior of the base pipe; and a wireless transmitter for controlling the electric actuator; and a shunt tube assembly adjacent the sand screen and the electronic flow control node. In other embodiments, the completion assembly may include a base pipe having a perforation therein and extending between a first end and a second end; a sand screen disposed around a portion of the base pipe and forming a sand screen flow path between the sand screen and the base pipe; a shunt tube assembly adjacent the sand screen, the shunt tube assembly having a transport tube and a packing tube, each tube having a passageway defined therein, the packing tube further including a plurality of nozzles, and an adjustable electronic flow control node disposed along the base pipe, the electronic flow control node comprising a valve body having an electronic flow control node flow path defined therethrough fluidically connecting a passageway of one of the tubes and the perforation; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism; and a wireless transmitter for controlling the electric actuator. In other embodiments, the completion assembly may include a base pipe having a perforation therein and extending between a first end and a second end; a sand screen disposed around a portion of the base pipe and forming a sand screen flow path between the sand screen and the base pipe; a shunt tube assembly adjacent the sand screen, the shunt tube assembly having a transport tube and a packing tube, each tube having a passageway defined therein, the packing tube further including a plurality of nozzles, and an adjustable electronic flow control node disposed along the base pipe, the electronic flow control node comprising a valve body having a first and second electronic flow control node flow paths defined therethrough, a first electronic flow control node flow path fluidically connecting a passageway of one of the tubes and the perforation and a second electronic flow control node flow path fluidically connecting the sand screen flow path and the perforation; a power harvesting mechanism; a valve disposed along one of the electronic flow control node flow path and moveable between a first position and a second position so as to adjust flow along an electronic flow control node flow path; an electric actuator for actuating the valve, and powered by the power harvesting mechanism; and a wireless transmitter for controlling the electric actuator. In other embodiments, the completion assembly may include a base pipe having a first perforation therein and extending between a first end and a second end; a sand screen disposed around a portion of the base pipe and forming a sand screen flow path between the sand screen and the base pipe; a shunt tube assembly adjacent the sand screen, the shunt tube assembly having a transport tube and a packing tube, each tube having a passageway defined therein, the packing tube further including a plurality of nozzles, and an adjustable electronic flow control node disposed along the base pipe, the electronic flow control node comprising a valve body having an electronic flow control node flow path defined therethrough fluidically connecting an upstream portion of one of the tubes and a downstream portion of one of the tubes; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism; and a wireless transmitter for controlling the electric actuator. In other embodiments, the completion assembly may include a first screen assembly comprising a base pipe having a first perforation therein and extending between a first end and a second end; a sand screen disposed around a portion of the base pipe and forming a sand screen flow path between the sand screen and the base pipe; an adjustable electronic flow control node disposed along the base pipe, the electronic flow control node comprising a valve body having an electronic flow control node flow path defined therethrough fluidically connecting the sand screen flow path and the perforation; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism disposed along a completion assembly flow path defined between an exterior of the sand screen and an interior of the base pipe; and a wireless transmitter for controlling the electric actuator; a second screen assembly comprising base pipe extending between a first end and a second end; a sand screen disposed around a portion of the base pipe and forming a sand screen flow path between the sand screen and the base pipe, wherein the first end of the base pipe of the first screen assembly is coupled to second end of the base pipe of the second screen assembly to form a joint therebetween; a connecting sleeve extending between the sand screen of the first screen assembly and the sand screen of the second sand screen assembly so as to span the joint between the coupled base pipes, the connecting sleeve defining a flow path between the connecting sleeve and the base pipes, the connecting sleeve flow path in fluid communication with the first screen assembly flow path and the second screen assembly flow path. In other embodiments, the completion assembly may include a first screen assembly comprising a base pipe having a first perforation therein and extending between a first end and a second end; a sand screen spaced apart from the perforation and disposed around a portion of the base pipe so as to form a sand screen flow path between the sand screen and the base pipe; an adjustable electronic flow control node disposed along the base pipe and spaced apart from the sand screen, the electronic flow control node comprising a valve body having an electronic flow control node flow path defined therethrough fluidically connecting the sand screen flow path and the perforation; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism disposed along a completion assembly flow path defined between an exterior of the sand screen and an interior of the base pipe; and a wireless transmitter for controlling the electric actuator; a connecting sleeve extending from the sand screen to the spaced apart electronic flow control node so as to form a fluidic passageway interconnecting the electronic flow control node flow path and the sand screen flow path; a second screen assembly comprising base pipe extending between a first end and a second end; a sand screen disposed around a portion of the base pipe and forming a sand screen flow path between the sand screen and the base pipe, wherein the first end of the base pipe of the first screen assembly is coupled to second end of the base pipe of the second screen assembly to form a joint therebetween; a connecting sleeve extending between the sand screen of the first screen assembly and the sand screen of the second sand screen assembly so as to span the joint between the coupled base pipes, the connecting sleeve defining a flow path between the connecting sleeve and the base pipes, the connecting sleeve flow path in fluid communication with the first screen assembly flow path and the second screen assembly flow path. In other embodiments, the completion assembly may include a first screen assembly comprising a base pipe having a first perforation therein and extending between a first end and a second end; a first sand screen spaced apart from the perforation between the perforation and the first base pipe end and a second sand screen spaced apart from the perforation between the perforation and the second base pipe end, each sand screen disposed around a portion of the base pipe so as to form a sand screen flow path between the sand screen and the base pipe; a connecting sleeve extending from the first sand screen to the second sand screen and spaced apart from the base pipe to form a fluidic passageway interconnecting the respective first and second sand screen flow paths; and an adjustable electronic flow control node disposed along the base pipe between the first and second sand screens, the electronic flow control node comprising a valve body having an electronic flow control node flow path defined therethrough fluidically connecting the sand screen flow paths, the fluidic passageway and the perforation; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism disposed along a completion assembly flow path defined between an exterior of the sand screen and an interior of the base pipe; and a wireless transmitter for controlling the electric actuator. In other embodiments, the completion assembly may include a plurality of interconnected sand screen assemblies, each sand screen assembly comprising a base pipe having at least one perforation therein and extending between a first end and a second end of the base pipe; a sand screen disposed around a portion of the base pipe and forming a sand screen flow path between the sand screen and the base pipe; an adjustable electronic flow control node disposed along the base pipe, the electronic flow control node comprising a valve body having an electronic flow control node flow path defined therethrough fluidically connecting the sand screen flow path and the perforation; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism disposed along a completion assembly flow path defined between an exterior of the sand screen and an interior of the base pipe; and a wireless transmitter for controlling the electric actuator, wherein the first end of a sand screen assembly base pipe is coupled to the second end of an adjacent sand screen assembly base pipe, thereby forming a completion string of interconnected sand screen assemblies, the completion string having a proximal end and a distal end; and a sealing mechanism adjacent the distal end of the completion string. In other embodiments, the completion assembly may include an elongated tool string having a distal portion and a proximal portion and a flow passage defined therein; a plurality of sand screen assemblies disposed along the distal portion of the elongated tool string and in fluid communication with the flow passage, each sand screen assembly comprising a base pipe having at least one perforation therein and extending between a first end and a second end of the base pipe; a sand screen disposed around a portion of the base pipe and forming a sand screen flow path between the sand screen and the base pipe; an adjustable electronic flow control node disposed along the base pipe, the electronic flow control node comprising a valve body having an electronic flow control node flow path defined therethrough fluidically connecting the sand screen flow path and the perforation; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism disposed along a completion assembly flow path defined between an exterior of the sand screen and an interior of the base pipe; and a wireless transmitter for controlling the electric actuator; and a wired controller spaced apart from the sand screen assemblies and positioned along the proximal end of the elongated tool string and disposed for transmitting wireless signals to the sand screen assembly electronic flow control nodes. In other embodiments, the completion assembly may include an elongated tool string having a distal portion and a proximal portion and a flow passage defined therein, wherein the proximal portion comprises an upper completion assembly and the distal portion comprises a lower completion assembly extending from a junction assembly along a first axis and a lateral completion assembly extending from the junction assembly along a second axis spaced apart from the first axis; a first plurality of sand screen assemblies disposed along the lower completion assembly and in fluid communication with the flow passage, and a second plurality of sand screen assemblies disposed along the lateral assembly and in fluid communication with the flow passage; each sand screen assembly comprising a base pipe having at least one perforation therein and extending between a first end and a second end of the base pipe; a sand screen disposed around a portion of the base pipe and forming a sand screen flow path between the sand screen and the base pipe; an adjustable electronic flow control node disposed along the base pipe, the electronic flow control node comprising a valve body having an electronic flow control node flow path defined therethrough fluidically connecting the sand screen flow path and the perforation; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism disposed along a completion assembly flow path defined between an exterior of the sand screen and an interior of the base pipe; and a wireless transmitter for controlling the electric actuator; and a wired controller spaced apart from the sand screen assemblies and positioned along the proximal end of the elongated tool string and disposed for transmitting wireless signals to the sand screen assembly electronic flow control nodes.

For any of the foregoing embodiments, one or more of the following elements may be combined alone therewith or with of the other following elements:

- A shunt tube assembly having a transport tube and a packing tube extending along at least a portion of the length of the base pipe, where each of the tubes has a passageway defined therein, the packing tube further including a plurality of nozzles.
- The shunt tube assembly is disposed radially outward of the sand screen.

The shunt tube assembly is disposed radially inward of the sand screen, between the sand screen and the base pipe.

The electronic flow control node is disposed between an upstream portion and a downstream portion of a transport tube.

The electronic flow control node is disposed between an upstream portion and a downstream portion of a packing tube.

The electronic flow control node comprises a valve body having first and second electronic flow control node flow paths defined therethrough; at least one power harvesting mechanism; a valve disposed along each of the electronic flow control node flow paths, each valve moveable between a first position and a second position so as to adjust flow along the respective electronic flow control node flow path; a first electric actuator for actuating the valve along the first flow path and a second electric motor for actuating the valve along the second flow path, each of the motors powered by a power harvesting mechanism; and a wireless transmitter for controlling the electric actuators.

The first electronic flow control node flow path is interconnects upstream and downstream portions of a transport tube and the second electronic flow control node flow path interconnects upstream and downstream portions of a packing tube.

The power harvesting mechanism is a fluid turbine generator.

The power harvesting mechanism is a vibrating power harvester comprising a blade.

The power harvesting mechanism is positioned at a point along a completion assembly flow path extending from an exterior of the sand screen to an interior of the base pipe, and disposed to generate power for the electronic flow control node from fluid flow along the completion assembly flow path.

The electronic flow control node valve, electronic flow control node electric actuator, electronic flow control node power harvesting mechanism; electronic flow control node wireless transmitter are mounted on the electronic flow control node body.

The base pipe comprises a plurality of perforations, and each perforation has an electronic flow control node controlling flow therethrough.

An additional adjustable electronic flow control node disposed along the base pipe, the additional electronic flow control node comprising a valve body having an electronic flow control node flow path defined therethrough fluidically connecting the sand screen flow path and the perforations; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism; and a wireless transmitter for controlling the electric actuator.

An additional adjustable electronic flow control node disposed along the base pipe, the electronic flow control node comprising a valve body having an electronic flow control node flow path defined therethrough fluidically connecting a passageway of one of the tubes and the perforations; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism; and a wireless transmitter for controlling the electric actuator.

The shunt tube assembly is positioned radially outward of both the sand screen and the electronic flow control node.

The shunt tube assembly comprises a packing tube with a plurality of nozzles.

The electronic flow control node valve is a ball valve.

The base pipe, sand screen and adjustable electronic flow control node comprise a first sand screen assembly, the completion assembly further comprising a second sand screen assembly having a perforated base pipe, a sand screen disposed around a portion of the perforated base pipe and forming a sand screen flow path between the sand screen and the base pipe; a shunt tube assembly adjacent the sand screen; an adjustable electronic flow control node disposed along the base pipe, the electronic flow control node comprising a valve body having an electronic flow control node flow path defined therethrough fluidically connecting the sand screen flow path and the perforations; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism; and a wireless transmitter for controlling the electric actuator, wherein the base pipe of the first sand screen is attached to the base pipe of the second sand screen assembly at a joint and the shunt tube assembly of the first sand screen assembly is in fluid communication with the shunt tube assembly of the second sand screen assembly via a jumper tube that spans the joint.

A plurality of interconnected third screen assemblies forming a string of third screen assemblies, each third screen assembly comprising a base pipe extending between a first end and a second end; a sand screen disposed around a portion of the base pipe and forming a sand screen flow path between the sand screen and the base pipe, wherein the first end of the base pipe of a third screen assembly is coupled to the second end of the base pipe of an adjacent third screen assembly to form a joint between coupled base pipes; a connecting sleeve extending between the sand screens of successive third screen assemblies to span the joint therebetween, each connecting sleeve defining a flow path between the connecting sleeve and the two base pipes radially adjacent thereto, the connecting sleeve flow path in fluid communication with the screen flow paths of the two interconnected third screen assemblies; the second screen assembly base pipe first end is coupled to a third screen assembly base pipe end to form a joint between the coupled base pipes of the second and third screen assemblies; and a connecting sleeve extending between the second sand screen assembly and the adjacent third sand screen assembly to span the joint therebetween, the connecting sleeve defining a flow path between the connecting sleeve and the two base pipes radially adjacent thereto, the connecting sleeve flow path in fluid communication with the screen flow paths of the interconnected third sand screen assembly and the second sand screen assembly.

An additional second screen assembly comprising base pipe extending between a first end and a second end; a sand screen disposed around a portion of the base pipe and forming a sand screen flow path between the sand screen and the base pipe, wherein the second end of the base pipe of the first screen assembly is coupled to the first end of the base pipe of the second screen assembly to form a joint therebetween; a connecting sleeve extending between the sand screen of the first screen assembly and the sand screen of the additional second sand screen assembly so as to span the joint between the coupled base pipes, the connecting sleeve defining a flow path between the connecting sleeve and the base pipes, the connecting sleeve flow path in fluid communication with the first screen assembly flow path and the additional second screen assembly flow path.

The base pipe perforation and electronic flow control node is spaced apart from the sand screen along the length of the base pipe, the completion assembly further comprising a connecting sleeve extending between the electronic flow control node and the space apart sand screen, the connecting sleeve defining a flow path between the connecting sleeve and the base pipe, the connecting sleeve flow path in fluid communication with the first screen assembly flow path and the electronic flow control node flow path.

The electronic flow control node is positioned along the base pipe adjacent the sand screen.

The electronic flow control node is positioned along the base pipe spaced apart from the sand screen, the completion assembly further comprising a connecting sleeve extending from the sand screen to the electronic flow control node so as to form a fluidic passageway interconnecting the electronic flow control node flow path and the sand screen flow path.

The base pipe comprises an injection perforation and an additional electronic flow control node, the additional electronic flow control node comprising a valve body having an electronic flow control node flow path defined therethrough fluidically connecting the injection perforation to an exterior of the sand screen; a power harvesting mechanism; a valve disposed along the electronic flow control node flow path and moveable between a first position and a second position so as to adjust flow along the electronic flow control node flow path; an electric actuator for actuating the valve, and powered by the power harvesting mechanism disposed along a completion assembly flow path defined between an exterior of the sand screen and an interior of the base pipe; and a wireless transmitter for controlling the electric actuator.

The injection perforation has a cross sectional flow area that is larger than the a cross-sectional flow area of the first perforation.

The first position of an electronic flow control node valve is a closed position and the second position of an electronic flow control node valve is an open position, the sand screen assembly closest to the distal end of the completion string having an electronic flow control node valve in the second position and the remaining electronic flow control nodes of the completion string having valves in the first position.

The proximal portion of the tool string comprises an upper completion assembly and the distal portion of the tool string comprises a lower completion assembly.

The proximal portion of the tool string comprises an upper completion assembly and the distal portion of the tool string comprises a lateral completion assembly.

The proximal portion of the tool string comprises an upper completion assembly and the distal portion of the tool string comprises a lateral completion assembly and a lower completion assembly.

The tool string comprises an upper completion assembly and a lower completion assembly and wherein the lower completion assembly comprises the plurality of sand screen assemblies and the upper completion assembly comprises the wired controller.

The tool string comprises an upper completion assembly and a lower completion assembly and a lateral completion assembly, wherein the lateral completion assembly comprises the plurality of sand screen assemblies and the upper completion assembly comprises the wired controller.

The tool string comprises an upper completion assembly and a lower completion assembly and a lateral completion assembly, wherein the lateral completion assembly and the lower completion assembly each comprise a plurality of sand screen assemblies and the upper completion assembly comprises the wired controller.

The proximal portion of the tool string comprises a first valve disposed to control flow from the sand screen assemblies along the flow passage.

The proximal portion of the tool string comprises a first valve to control flow through the flow passage from a first set of sand screen assemblies and a second valve to control flow through the flow passage from a second set of sand screen assemblies.

The first set of sand screen assemblies comprises a lower completion assembly of the tool string and the second set of sand screen assemblies comprise a lateral completion assembly of the tool string.

The tool string comprises a junction assembly and the wired controller is positioned along the tool string upstream of the junction assembly and the sand screen assemblies are positioned along the tool string assembly downstream of the junction assembly.

The junction assembly further comprises a defector and a deformable conduit.

A first tubular string extends from the junction assembly substantially coaxially with a main axis of the tool string assembly and a second tubular string extends from the junction assembly spaced apart from the first tubular string, wherein each tubular string is in fluid communication with a plurality of sand screen assemblies disposed at a distal end of each tubular string.

The valves disposed along the proximal portion of the tool string are in wired communication with the controller.

The controller comprises a transmitter for transmitting a wireless signal.

The wireless signal is a pressure signal.

The wireless signal is an electromagnetic signal.

An electronic flow control node further comprises a sensor electrically coupled to a wireless transmitter.

The electronic flow control node sensor is selected from the group consisting of a pressure sensor, a temperature sensor and a flow rate sensor.

The wireless transmitter is an electromagnetic transmitter.

The wireless transmitter is a pressure transducer.

The wireless transmitter is an electromagnetic transmitter.

The wireless transmitter is a pressure transducer.

The electronic flow control node has a first valve and a second valve.

The electronic flow control node has a first port, a second port and a third port.

A first port of the electronic flow control node is in fluid communication with a base pipe, a second port of the electronic flow control node is in fluid communication with a sand screen assembly and a third port of the electronic flow control node is in fluid communication with a shunt tube assembly.

The power harvesting mechanism is disposed along an electronic flow control node flow path.

The power harvesting mechanism is disposed along a flow path defined by the sand screen.

The power harvesting mechanism is disposed along a flow path external of the base pipe.

The power harvesting mechanism is disposed along a flow path external to the electronic flow control node body.

Likewise, a method for performing completion operations in a wellbore has been described.

The method may include injecting a fluid into a wellbore by positioning a completion assembly adjacent a production zone in a wellbore; pumping a fluid down a tubing string to the completion assembly; actuating an electronic flow control node carried by the completion assembly to open a valve in the electronic flow control node; and directing fluid flow through the electronic flow control node from the completion assembly into the wellbore annulus around a sand screen of the completion assembly. The method may include gravel packing a wellbore by positioning a completion assembly adjacent a production zone in a wellbore; pumping a gravel pack slurry down a tubing string to the completion assembly; actuating an electronic flow control node carried by the completion assembly to open a valve in the electronic flow control node; and directing slurry flow through the electronic flow control node from the completion assembly into the wellbore annulus around a sand screen of the completion assembly. The method may include gravel packing a wellbore by positioning a completion assembly adjacent a production zone in a wellbore; pumping a gravel pack slurry down a tubing string to the completion assembly having a plurality of sand screen assemblies with interconnected shunt tubes; actuating an electronic flow control node carried by the completion assembly to open a valve in the electronic flow control node; and directing slurry flow through the electronic flow control node from a first sand screen assembly to a second sand screen assembly via the interconnected shunt tubes. The method may include positioning a completion assembly adjacent a production zone in a wellbore; transmitting a first signal to actuate a first electronic flow control node carried by the completion assembly to open a valve in the first electronic flow control node; pumping a working fluid down a tubing string to the completion assembly having a plurality of sand screen assemblies; utilizing the first electronic flow control node to inject the working fluid into wellbore by directing working fluid flow through the first electronic flow control node to the wellbore annulus; transmitting a second signal to actuate a second electronic flow control node carried by the completion assembly to open a valve in the second electronic flow control node; and utilizing the second electronic flow control node to control flow of formation fluids through the a sand screen and into a tubing string. The method may include gravel packing a wellbore annulus by positioning a string of successive, fluidically interconnected sand screen assemblies adjacent a production zone in a wellbore, each sand screen assembly carrying an electronic flow control node with a valve in a closed position; actuating the electronic flow control node of the sand screen assembly positioned at the distal most end of the string to open a valve in the actuated electronic flow control node; pumping a gravel pack slurry down a tubing string to the actuated electronic flow control node; and directing slurry flow through the open valve of the actuated electronic flow control node from the screen assembly into the wellbore annulus in order to gravel pack around the screen assembly. The method may include controlling flow of a fluid in a wellbore positioning a string of successive, fluidically interconnected sand screen assemblies adjacent a production zone in a wellbore, each sand screen assembly carrying an electronic flow control node with a valve in a closed position; actuating one or more electronic flow control node of their respective sand screen assemblies to open a valve in each actuated electronic flow control node; pumping a working fluid down a tubing string to the actuated electronic flow control nodes; and directing working fluid flow through the open valves of the actuated electronic flow control nodes from the screen assemblies into the wellbore annulus. The method may include controlling flow of a fluid in a wellbore by positioning a string of fluidically interconnected sand screen assemblies adjacent a production zone in a wellbore, each sand screen assembly carrying an electronic flow control node; transmitting a wireless signal to the electronic flow control nodes of the sand screen assemblies from a wired transmitter spaced apart from and located upstream of the sand screen assemblies; and utilizing the wireless signal to actuate one or more electronic flow control nodes of their respective sand screen assemblies to adjust a valve in each actuated electronic flow control node, thereby controlling fluid flow through the associated sand screen assembly.

For any of the foregoing embodiments, one or more of the following elements may be combined alone therewith or with of the other following elements:

Actuating comprises transmitting a wireless signal to the electronic flow control node and utilizing the wireless signal to drive the electronic flow control node from a closed position, whereby slurry flow through the electronic flow control node is blocked to an open position, whereby slurry flow passes through the electronic flow control node.

Utilizing the wireless signal to drive an electric actuator of the electronic flow control node and alter the cross-sectional opening of the electronic flow control node valve.

Frac packing by hydraulic fracturing of a production zone at the same time the annulus is gravel packed.

Directing the slurry flow from the electronic flow control node into a shunt tube and deploying the slurry into the annulus around the sand screen utilizing the shunt tube.

Utilizing flow through the electronic flow control node to generate power to actuate the electronic flow control node.

Actuating an electronic flow control node to control slurry flow to shunt tubes in the completion assembly downstream of the electronic flow control node.

Actuating comprises transmitting a wireless signal to the electronic flow control node and utilizing the wireless signal to drive the electronic flow control node from a closed position, whereby slurry flow through the electronic flow control node is blocked to an open position, whereby slurry flow passes through the electronic flow control node to downstream shunt tube assemblies.

Actuating comprises utilizing production tubing flow to drive a turbine of the electronic flow control node in order to provide power to adjust a valve in the electronic flow control node.

Transmitting a wireless signal to close the first electronic flow control node upon completion of injection of the working fluid.

Actuating comprises transmitting a wireless signal to the electronic flow control node.

Actuating comprises providing a timing signal to the electronic flow control node.

Receiving a signal that the gravel pack around the screen assembly with the actuated electronic flow control node has reached a desired degree of completion; and actuating the electronic flow control node of a sand screen assembly positioned upstream of the gravel packed screen assembly; pumping a gravel pack slurry down a tubing string to the actuated electronic flow control node of the upstream screen assembly; and directing slurry flow through the open valve of the actuated electronic flow control node of the upstream screen assembly from the upstream screen assembly into the wellbore annulus in order to gravel pack around the upstream screen assembly.

Transmitting a wireless signal to close the first electronic flow control node upon completion of injection of the working fluid.

The steps of actuating, pumping and directing are repeated successively from the distal most sand screen assembly to the proximal most sand screen assembly in the string.

The signal is a rise in pressure fluid pressure measured adjacent the gravel packed sand screen assembly.

The signal is a rise in fluid temperature measured adjacent the gravel packed sand screen assembly.

The signal is a drop in the flow rate of fluid flow between the sand screen assembly and the annulus around the sand screen assembly.

The signal is a drop in the flow rate of fluid flow from the sand screen assembly out of the actuated electronic flow control node.

The signal is a drop in the flow rate of fluid flow from the wellbore annulus into the sand screen assembly of the actuated electronic flow control node.

Each of the electronic flow control node valves of the successive sand screen assemblies remains open after completion of the gravel packing around the respective sand screen assemblies.

Each of the electronic flow control node valves of the successive sand screen assemblies is closed after completion of the gravel packing around the respective sand screen assemblies.

Upon completion of gravel packing around the string, transmitting a signal to a plurality of the electronic flow control nodes and utilizing the signal to drive the valves from a gravel packing configuration to a production configuration, whereby the valves are at least partially closed from their open positions; and thereafter, utilizing the electronic flow control nodes to manage production flow.

The signal is generated from a sensor positioned adjacent the respective electronic flow control node.

The steps of actuating, pumping and directing are repeated for two or more sand screen assemblies.

The steps of actuating, pumping and directing are repeated for a plurality of sand screen assemblies.

The electronic flow control nodes are actuated sequentially from a distal sand screen assembly to a proximal sand screen assembly located upstream of the distal sand screen assembly.

The electronic flow control nodes are actuated simultaneously.

The working fluid is a filter cake breaker.

The working fluid is a hydraulic fracturing fluid.

The working fluid is a gravel pack slurry.

The working fluid is an acidizing fluid.

The valves of the electronic flow control nodes are sequentially closed along the string.

At least partially closing an open electronic flow control node valve upon completion of a pumping activity.

Pumping a working fluid down a tubing string to the actuated electronic flow control nodes; and directing the working fluid flow through the open valves of the actuated electronic flow control nodes from the screen assemblies into the wellbore annulus.

Directing a formation fluid flow through the open valves of the actuated electronic flow control nodes from the screen assemblies into the interior of the sand screen assembly.

Positioning comprises deploying the sand screen assemblies in a lateral wellbore extending from a main wellbore; and wherein transmitting comprises generating a wireless signal from the main wellbore.

Positioning comprises deploying sand screen assemblies in a main wellbore downstream of a junction assembly; and wherein transmitting comprises generating a wireless signal from the main wellbore upstream of the junction assembly.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

The invention claimed is:

1. A completion assembly for deployment in a wellbore, the completion assembly comprising:

(a) an elongated tool string having a distal portion and a proximal portion and a flow passage defined therein, wherein the proximal portion comprises an upper completion assembly and the distal portion comprises (i) a lower completion assembly extending from a junction assembly along a first axis and (ii) a lateral completion assembly extending from the junction assembly along a second axis spaced apart from the first axis;

(b) a first plurality of sand screen assemblies disposed along the lower completion assembly and in fluid communication with the flow passage, and a second plurality of sand screen assemblies disposed along the lateral completion assembly and in fluid communication with the flow passage;

(c) each sand screen assembly comprising a base pipe having at least one perforation therein and extending between a first end and a second end of the base pipe; a sand screen disposed around a portion of the base pipe and forming a sand screen flow path between the sand screen and the base pipe; an adjustable electronic flow control node disposed along the base pipe, the electronic flow control node comprising a valve body having an electronic flow control node flow path defined therethrough fluidically connecting the sand screen flow path and the perforation; a power harvesting mechanism; a valve disposed along the electronic flow control node flow path and moveable between at least a first position and a second position so as to adjust flow along the electronic flow control node flow path; an electric actuator for actuating the valve, and powered by the power harvesting mechanism disposed; and a wireless transmitter for controlling the electric actuator; and (d) a controller spaced apart from the sand screen assemblies and positioned along the upper completion assembly above the junction assembly, the controller coupled to the surface by one or more control wires and wirelessly coupled to the sand screen assembly electronic flow control nodes below the junction assembly, wherein the controller comprises a transmitter for transmitting a wireless pressure or flow rate signal, and wherein the wireless transmitter of each electronic flow control nodes below the junction assembly is operable to receive the pressure or flow rate signal.

2. The completion assembly of claim 1, wherein a first tubular string extends from the junction assembly substantially coaxially with a main axis of the tool string assembly and a second tubular string extends from the junction assembly spaced apart from the first tubular string, wherein each tubular string is in fluid communication with a plurality of sand screen assemblies disposed at a distal end of each tubular string.

3. The completion assembly of claim 1, further comprising at least one valve disposed along the proximal portion of the tool string, wherein the valve disposed along the proximal portion of the tool string is in wired communication with the controller.

4. The completion assembly of claim 1, wherein a plurality of electronic flow control nodes further comprise a sensor electrically coupled to the wireless transmitter of the electronic flow control node.

5. The completion assembly of claim 1, wherein at least one sand screen assembly further comprises a shunt tube assembly adjacent the sand screen, the shunt tube assembly comprising a transport tube and a packing tube extending along at least a portion of the length of the base pipe, where each of the tubes has a passageway defined therein, the packing tube further including a plurality of nozzles.

6. The completion assembly of claim 5, wherein an electronic flow control node valve of a sand screen assembly is disposed along the passageway of the transport tube and the electronic flow control node flow path is fluidically connected to the transport tube passageway.

7. The completion assembly of claim 5, wherein an electronic flow control node valve of a sand screen assembly is disposed along the passageway of the packing tube and the electronic flow control node flow path is fluidically connected to the packing tube passageway.

8. The completion assembly of claim 1, further comprising a second screen assembly comprising a second base pipe extending between a first end and a second end; a second sand screen disposed around a portion of the second base pipe and forming a second sand screen flow path between the second sand screen and the second base pipe, wherein the first end of a base pipe of a first screen assembly is coupled to second end of the base pipe of the second screen assembly to form a joint therebetween;

a connecting sleeve extending between the sand screen of the first sand screen assembly and the second sand screen so as to span the joint between the coupled base pipes, the connecting sleeve defining a flow path between the connecting sleeve and the base pipes, the connecting sleeve flow path in fluid communication with the first screen assembly flow path and the second screen assembly flow path.

9. A completion assembly for deployment in a wellbore, the completion assembly comprising:

(a) an upper completion assembly;

(b) a junction assembly attached to a lower portion of the upper completion assembly;

(c) a lower completion assembly extending from the junction assembly along a first axis;

(d) a lateral completion assembly extending from the junction assembly along a second axis spaced apart from the first axis;

(e) at least one sand screen assembly disposed along the lower completion assembly;

(f) at least one sand screen assembly disposed along the lateral completion assembly;

(g) each sand screen assembly comprising a base pipe having at least one perforation therein and extending between a first end and a second end of the base pipe; a sand screen disposed around a portion of the base pipe and forming a sand screen flow path between the sand screen and the base pipe; an adjustable electronic flow control node disposed along the base pipe, the electronic flow control node comprising a valve body having an electronic flow control node flow path defined therethrough fluidically connecting the sand screen flow path and the perforation; a power harvesting mechanism; a valve disposed along the electronic flow control node flow path and moveable between at least a first position and a second position so as to adjust flow along the electronic flow control node flow path; an electric actuator for actuating the valve, and powered by the power harvesting mechanism; and (h) a wired controller positioned along the upper completion assembly and disposed for transmitting wireless signals to at least the sand screen assembly electronic flow control node of the lateral completion assembly;

wherein the lateral completion assembly electronic flow control node further comprises a wireless transmitter for controlling the electric actuator of the lateral completion assembly electronic flow control node;

wherein at least one sand screen assembly further comprises a shunt tube assembly adjacent the sand screen, the shunt tube assembly comprising a transport tube and a packing tube extending along at least a portion of the length of the base pipe, where each of the tubes has a passageway defined therein, the packing tube further including a plurality of nozzles; and wherein an electronic flow control node valve of a sand screen assembly is disposed along the passageway of at least one of the tubes, and the electronic flow control node flow path is fluidically connected to a tube passageway.

10. The completion assembly of claim 9, wherein the lower completion assembly comprises a first tubular string extending from the junction assembly substantially coaxially with a main axis of the upper completion assembly and the lateral completion assembly comprises a second tubular string extending from the junction assembly spaced apart from the first tubular string, wherein each tubular string is in fluid communication with a plurality of sand screen assemblies disposed at a distal end of each tubular string.

11. The completion assembly of claim 9, further comprising at least one valve disposed along the upper completion assembly, wherein the valve disposed along the upper completion assembly is in wired communication with the controller.

12. The completion assembly of claim 9, wherein the controller comprises a transmitter for transmitting a wireless signal.

13. The completion assembly of claim 9, wherein at least one electronic flow control node further comprise a sensor electrically coupled to the wireless transmitter of the electronic flow control node.

14. The completion assembly of claim 9, wherein the controller comprises a transmitter for transmitting a wireless pressure or flow rate signal, and wherein the wireless transmitter of each electronic flow control nodes below the junction assembly is operable to receive the pressure or flow rate signal.

15. The completion assembly of claim 9, wherein the electronic flow control node valve of the sand screen assembly disposed along the passageway of the at least one of the tubes includes a port in fluid communication with the base pipe.

16. A completion assembly for deployment in a wellbore, the completion assembly comprising:

(a) an upper completion assembly;

(b) a junction assembly attached to a lower portion of the upper completion assembly;

(c) a lower completion assembly extending from the junction assembly along a first axis;

(d) a lateral completion assembly extending from the junction assembly along a second axis spaced apart from the first axis;

(e) a plurality of interconnected sand screen assemblies comprising the lateral completion assembly, the lateral completion assembly having a proximal end and a distal end; and a sealing mechanism adjacent the distal end of the lateral completion assembly, wherein each sand screen assembly comprises:

a base pipe having at least one perforation therein and extending between a first end and a second end of the base pipe; a sand screen disposed around a portion of the base pipe and forming a sand screen flow path between the sand screen and the base pipe;

an adjustable electronic flow control node disposed along the base pipe, the electronic flow control node comprising a valve body having an electronic flow control node flow path defined therethrough fluidically connecting the sand screen flow path and the perforation; a power harvesting mechanism; a valve disposed along the electronic flow control node flow path and moveable between at least a first position and a second position so as to adjust flow along the electronic flow control node flow path; an electric actuator for actuating the valve, and powered by the power harvesting mechanism; and a wireless transmitter for controlling the electric actuator, wherein the first end of a sand screen assembly base pipe is coupled to the second end of an adjacent sand screen assembly base pipe; and (h) a controller positioned along the upper completion assembly above the junction assembly, the controller coupled to the surface by one or more control wires and wirelessly coupled to the wireless electronic flow control node transmitters of the lateral completion assembly below the junction assembly, wherein the controller comprises a transmitter for transmitting a wireless pressure or flow rate signal, and wherein the wireless transmitter of each electronic flow control nodes below the junction assembly is operable to receive the pressure or flow rate signal.

17. The completion assembly of claim 16, wherein at least one electronic flow control node further comprise a sensor electrically coupled to the wireless transmitter of the electronic flow control node.

18. The completion assembly of claim 17, wherein the sensor is selected from the group consisting of a pressure sensor, a temperature sensor and a flow rate sensor.

19. The completion assembly of claim 16, wherein at least one sand screen assembly further comprises a shunt tube assembly adjacent the sand screen, the shunt tube assembly comprising a transport tube and a packing tube extending along at least a portion of the length of the base pipe, where each of the tubes has a passageway defined therein, the packing tube further including a plurality of nozzles.

20. The completion assembly of claim 19, wherein an electronic flow control node valve of a sand screen assembly is disposed along the passageway of at least one of the tubes, and the electronic flow control node flow path is fluidically connected to a tube passageway.

* * * * *